US006061539A

United States Patent [19]

Ishiyama et al.

[11] Patent Number: 6,061,539

[45] **Date of Patent: *May 9, 2000**

[54] CHARGING MEMBER, CHARGING DEVICE AND IMAGE FORMING APPARATUS

[75] Inventors: Harumi Ishiyama, Yokohama; Yasushi Sato, Kawasaki; Hideyuki Yano, Yokohama; Tadashi Furuya, Kawasaki; Yasunori Chigono, Yokohama; Seiji Mashimo, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/512,342

[22] Filed: Aug. 8, 1995

[30] Foreign Application Priority Data

| | | | |
|---|---|---|---|
| Apr. 8, 1994 | [JP] | Japan | 6-208066 |
| Aug. 8, 1994 | [JP] | Japan | 6-205959 |
| Aug. 8, 1994 | [JP] | Japan | 6-205961 |
| Jul. 31, 1995 | [JP] | Japan | 7-194997 |

[51] Int. Cl.[7] ..... G03G 15/02

[52] U.S. Cl. ..... 399/175; 361/221; 399/176

[58] Field of Search ..... 399/174, 175, 399/176; 361/220, 221

[56] References Cited

U.S. PATENT DOCUMENTS

| | | | |
|---|---|---|---|
| 5,010,370 | 4/1991 | Araya et al. . | |
| 5,084,733 | 1/1992 | Katoh et al. . | |
| 5,235,386 | 8/1993 | Yano et al. . | |
| 5,272,505 | 12/1993 | Shishido et al. . | |
| 5,357,323 | 10/1994 | Haneda et al. | 355/219 |
| 5,398,102 | 3/1995 | Wada et al. | 399/174 |
| 5,432,033 | 7/1995 | Asanae et al. | 399/176 X |
| 5,446,615 | 8/1995 | Matsumoto et al. | 399/174 X |
| 5,450,171 | 9/1995 | Demura et al. | 355/219 |
| 5,576,805 | 11/1996 | Ishihara et al. | 399/176 |
| 5,596,394 | 1/1997 | Nishiguchi et al. | 399/175 |

FOREIGN PATENT DOCUMENTS

| | | |
|---|---|---|
| 0 035 745 A2 | 9/1991 | European Pat. Off. . |
| 0 593 245 A1 | 4/1994 | European Pat. Off. . |
| 0 598 483 A1 | 5/1994 | European Pat. Off. . |
| 60-205550 | 10/1985 | Japan . |
| 60-205551 | 10/1985 | Japan . |
| 5-100544 | 4/1993 | Japan . |
| 6-110296 | 4/1994 | Japan . |
| 6-118770 | 4/1994 | Japan . |

OTHER PUBLICATIONS

Patent Abstracts Of Japan, vol. 018, NO. 405 (P–1778), Jul. 28, 1994, relating to JP 06–118770, published Apr. 28, 1994.

Patent Abstracts Of Japan, vol. 17, No. 451 (P–1595), Aug. 18, 1993, relating to JP 5–100544, published Apr. 23, 1993.

*Primary Examiner*—William Royer

*Attorney, Agent, or Firm*—Fitzpatrick, Cella, Harper & Scinto

[57] ABSTRACT

A charging member supporting magnetic particles for charging a member to be charged, including: an electroconductive member to which a voltage is applicable; and a member electrically insulated from the electroconductive member at an end portion, in a longitudinal direction of the charging member, of the magnetic particles, wherein deposition of magnetic particles to the member to be charged from the charging member is effectively prevented.

37 Claims, 12 Drawing Sheets

FIG. 10B
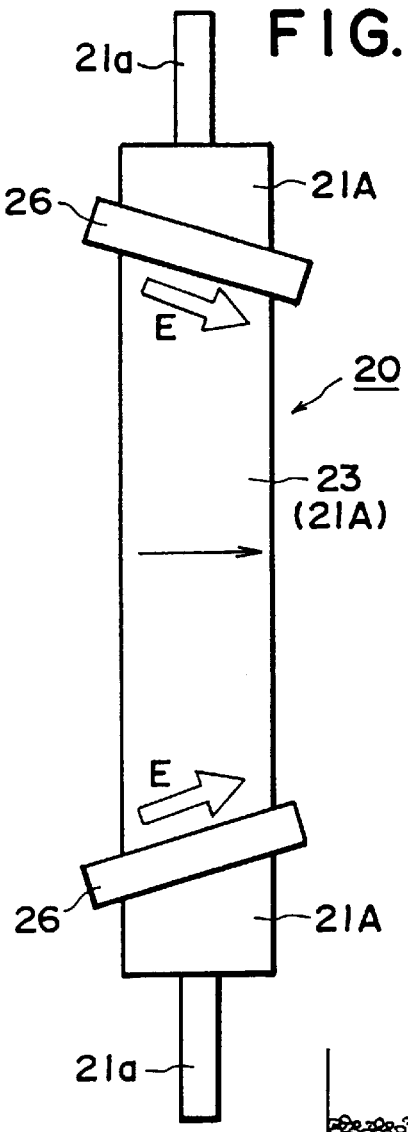
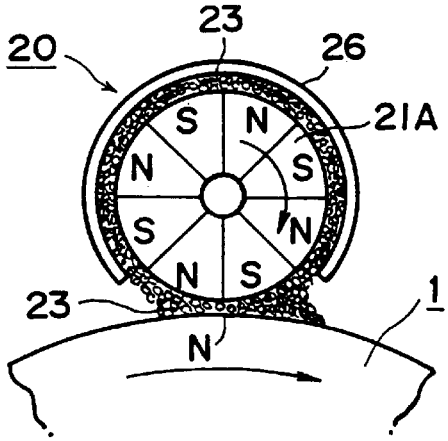
FIG. 10A
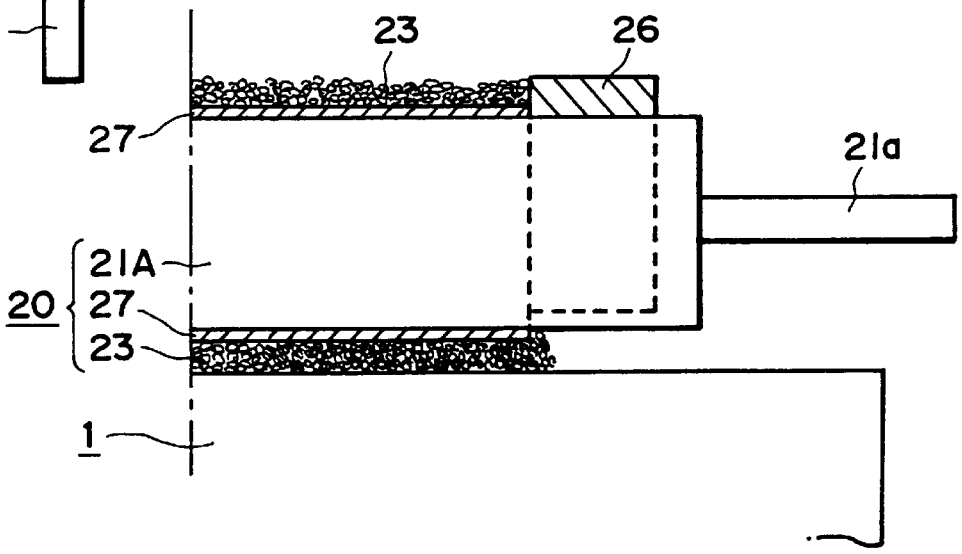
FIG. 10C

CHARGING MEMBER, CHARGING DEVICE AND IMAGE FORMING APPARATUS

FIELD OF THE INVENTION AND RELATED ART

The present invention relates to a charging member for effecting charging using magnetic particles, a charging device and an image forming apparatus, which are particularly suitable to an electrophotographic copying machine or a printer of the same type.

As for a charging method in an electrophotographic apparatus, a corona charging type using a wire and a shield, has been mainly used. Recently, however, from the standpoint of environment problem, a contact charging type becomes widely used because of small amount of ozone product due to the discharge. As one of such a contact charging type, there is known a magnetic brush type wherein magnetic particles are contacted to a photosensitive member as a member to be charged. The charging member of magnetic brush type is provided with a magnet roller as a magnetic force production member, for example, a rotatable non-magnetic electrode sleeve around the outward of the magnet roller, and a layer of the magnetic particles attracted and supported on the surface of the electrode sleeve by the magnetic force of the magnet roller. In order to charge the photosensitive member, the layer of the magnetic particle is contacted to the photosensitive member, and the electrode sleeve is supplied with a voltage. In the magnetic brush type, the magnetic particles are pushed out to an end of the charging member in the longitudinal direction (generating line direction of the photosensitive member). In the end portion region, the magnetic brush is not always contacted to the photosensitive member, the uniform charging is difficult. Therefore, the potential of the photosensitive member in the end portion region, is quite lower than that in the central portion region. For this reason, the potential of the electrode sleeve and the potential of the surface of the photosensitive member, are significantly different in the end portion region, with the result that the magnetic particles move to the photosensitive member from the charging member. If the magnetic particle is deposited to the photosensitive member, the amount of the magnetic particles on the magnetic particle gradually decreases with the result of charging defect. The charging defect leads to deterioration of the image, the long term use is not possible with the magnetic brush type.

SUMMARY OF THE INVENTION

Accordingly, it is a principal object of the present invention to provide a charging member, a charging device and an image forming apparatus, herein deposition of magnetic particles to the member to be charged from the charging member is effectively prevented.

It is another object of the present invention to provide a charging member, a charging device and an image forming apparatus, wherein proper image formation can be maintained for a long term.

These and other objects, features and advantages of the present invention will become more apparent upon a consideration of the following invention taken in conjunction with the accompanying drawings.

BRIEF DESCRIPTION OF THE DRAWINGS

FIG. 10A is a schematic cross-sectional view of a magnetic brush type charging member of a device, FIG. 10B is a schematic plan sectional view of a magnetic brush type charging member, and FIG. 10C is a schematic longitudinal sectional view of an end portion.

DESCRIPTION OF THE PREFERRED EMBODIMENT

Embodiment 1 (FIGS. 1, 2A, 2B and 3)

Figure 1:
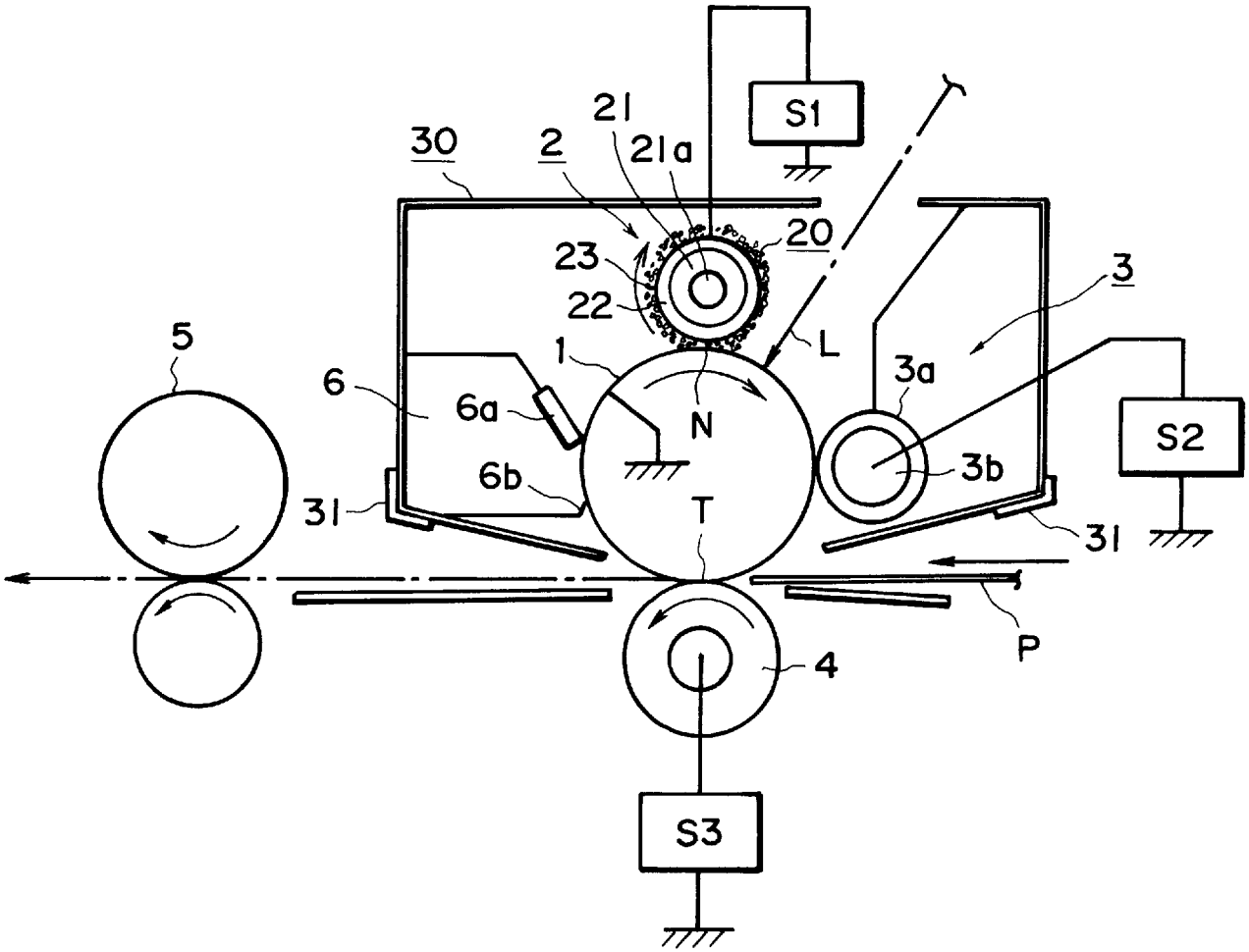
FIG. 1 is an a schematic illustration of an example of an image forming apparatus.

An example of image forming apparatus (FIG. 1)

FIG. 1 shows a structure of an example of an image forming apparatus. The image forming apparatus of this embodiment is in the form of a laser beam printer of electrophotographic process type.

Designated by 1 is a rotation drum type electrophotographic photosensitive member (drum) as an image bearing member (member to be charged). In this embodiment, it is a OPC photosensitive member having the negative charge polarity and having a diameter of 30 mm, and is rotated in a clockwise direction indicated by an arrow at a process speed (peripheral speed) of 100 mm/sec.

Designated by 2 is a charging device using a contact charging member 20 of a magnetic brush type, which will be described hereinafter. The drum 1 is charged (primary charging) uniformly to a predetermined polarity and potential by the charging device 2 during the rotation. In this embodiment, a DC charging bias of −700 V is applied from a charging bias application voltage source S1 to an electrode sleeve 22 of a magnetic brush type charging member 20, so that the outer peripheral surface of rotation drum 1 is uniformly charged to substantially −700 V by charge injection charging.

The charged surface of the rotation drum 1 is scanned by and exposed to a laser beam L modulated in the intensity in accordance with a time series electrical digital pixel signal, indicative of intended image information supplied from unshown laser beam scanner including a laser diode, polygonal mirror and the like.

The electrostatic latent image is developed into a toner image by a reverse development device 3 using magnetic one component insulative toner (negative toner). Designated by 3*a* is a non-magnetic developing sleeve having a diameter of 16 mm and enclosing a magnet 3*b*. The negative toner toner is applied on the developing sleeve 3*a*, and the developing sleeve 3*a* is rotated with a fixed distance of 300 microns from the drum 1 surface at the same speed as the drum 1, while the sleeve 3*a* is supplied with a developing bias voltage from a developing bias voltage source S2. The voltage is a DC voltage of −500 V biased with a −500 V of rectangular wave having a frequency of 1800 Hz and a peak-to-peak voltage of 1600 V to effect jumping development in the gap between the sleeve 3*a* and the photosensitive member 1.

On the other hand, a transfer material P as recording material is supplied from an unshown sheet feeding portion and fed at a predetermined timing to a press-contact nip portion (transfer portion) T formed between the rotation drum 1 and the transfer roller 4 of an intermediate resistance of $10^6$–$10^9$ Ohm as contact transfer means press-contacted to the rotation drum 1 with a predetermined pressure. A predetermined transfer bias voltage is applied from a transfer bias application voltage source S3 to the transfer roller 4. In this embodiment, the roller resistance value is $5\times10^8$ Ohm, and the roller is supplied with a DC voltage of +2000 V.

The transfer material P introduced into the transfer portion T is passed through the transfer portion T, during which the toner image is transferred from the rotation drum 1 to the surface of the transfer material P by electrostatic force and pressure.

The transfer material P now having the toner image is separated from the surface of the drum 1, and is introduced to a fixing device 5 of heat fixing type or the like, where the toner image is fixed on the recording material, and is discharged to the outside of the apparatus as a print.

The surface of the drum after the toner image transfer, is cleaned by a cleaning device 6 so that the foreign matter such as residual toner is removed therefrom to be prepared for the repeated image forming operation. The toner is removed by the cleaning blade 6*a*, and the toner in the cleaning device 6 is prevented from scattering to the outside by a receptor sheet.

In this embodiment, the printer is a process cartridge type printer, wherein four process means, namely, the drum 1, the contact charging member 20, the developing device 3 and cleaning device 6 are contained in a cartridge 30. Designated by 31 is mounting-and-demounting guide and supporting member for the cartridge 30. The image forming apparatus is not limited to such a process cartridge type.

(2) photosensitive member (drum) 1

The drum 1 as the member to be charged used in this embodiment is an OPC photosensitive member of the negative charge polarity, and comprises an electrically grounded drum base 1*a* of aluminum having a diameter of 30 mm and first to fifth function layers thereon in this order.

The first layer on the base is an electroconductive primer layer functioning to smooth defects of the aluminum drum base and to prevent moire attributable to the reflection of the laser exposure beam.

The second layer is a positive charge injection layer, which functions to prevent the positive charge injected from the aluminum drum base from neutralizing the negative charge applied on the photosensitive member surface. The second layer is an intermediate resistance layer having a thickness of approximately 1 micron. The resistance thereof is adjusted by AMILAN (tradename of polyamide resin material, available from Toray Kabushiki Kaisha, Japan) resin material and methoxymethyl nylon.

The third layer is a charge generating layer of disazo pigment dispersed in a resin material and having a thickness of approximately 0.3 microns. It produces a pair of positive and negative charge when it is subjected to laser exposure.

The fourth layer is a charge transfer layer of hydrazone dispersed in polycarbonate resin material, and is a P-type semiconductor. Therefore, the negative charge on the photosensitive member surface cannot move through the layer, and can transfer only the positive charge produced in the charge generating layer to the photosensitive member surface.

The fifth layer is a charge injection layer as a surface charge injection layer, and is an applied layer of $SnO_2$ ultra-fine particle dispersed in the light curing acrylic resin material. More particularly, the $SnO^2$ particles having a particle size of approximately 0.03 microns doped with antimony to lower the resistance thereof are dispersed in the resin material in the amount of 70 wt %. The painting liquid thus provided is applied as the charge injection layer into the thickness of approximately 2 microns by dipping. By doing so, the volume resistivity of the photosensitive member surface is lowered to volume resistivity $1\times10^{12}$ Ohm.cm from $1\times10^{15}$ Ohm.cm in the case of of the charge transfer layer alone. It is preferable that the volume resistivity of the charge injection layer is $1\times10^9$–$1\times10^{15}$ Ohm.cm. The volume resistivity is measured using a sheet-like sample with the voltage of 100 V, and it is measured using HIGH RESISTANCE METER 4329A available from YHP to which RESISTIVITY CELL 16008A is connected.

(3) charging device 2

Structures

In the charging device 2 of this embodiment, a magnetic brush type charging member 20, as shown in FIG. 2(*a*), comprises a magnet roller 21, an outside rotatable non-magnetic electrode sleeve 22 coaxial therewith, and a magnetic brush 23 of magnetic particles attracted on the outer peripheral surface of the electrode sleeve 22 by the magnetic force of the magnet roller 21 therein. The magnetic flux density on the electrode sleeve 22 provided by the magnet roller 21, is $800\times10^4$T (tesla).

The charging member 20 is positioned substantially in parallel with the drum (photosensitive member) 1 as the member to be charged so that the magnetic brush 23 is contacted to the surface of the drum 1, by the shaft 21*a* of the magnet roller 21 being supported by unshown bearing portion. The magnet roller 21 is not rotatable, but the non-magnetic electrode sleeve 22 is rotated at a predetermined peripheral speed in the clockwise direction direction indicated by an arrow by unshown driving means. In the charging nip portion N formed with the drum 1, the magnetic brush 23 is in contact with the surface of the drum 1, and the electrode sleeve 22 is rotated in the opposite direction relative to the drum 1 at the nip portion N.

More particularly, the magnetic brush 23 on the electrode sleeve 21 has a thickness of 1 mm to form a charging nip portion N of a width of approximately 5 mm relative to the drum 1. In this embodiment, the amount of the magnetic particle of the magnetic brush 23 is approximately 10 g, and the gap of the charging nip portion N between the electrode sleeve 22 and drum 1 is 500 microns approximately. A charging bias is applied from the charging bias application voltage source S1 to the electrode sleeve 22 which functions as an electric energy supply portion for the magnetic brush 23.

Thus, the drum 1 and the electrode sleeve 22 are rotated, and the charging bias of the predetermined polarity and potential is applied, by which the charge injection is effected from the magnetic brush 23 into the electroconductive particles in the charge injection layer at the drum 1 surface, so that the surface of the drum 1 is charged to a predetermined polarity and potential threw injection charging.

The peripheral speed ratio between the magnetic brush 23 and the drum 1 is defined as follows:

Peripheral speed ratio %

The peripheral speed of the magnetic brush 23 is negative when the counterdirectional rotation is used.

The peripheral speed ratio of—100% means that the magnetic brush 23 is resting, and therefore, the configuration of the magnetic brush 23 contacted to the drum surface appear as it is on the resultant image as a result of the charging defect. In the case of the forward rotation, the rotational speed of the magnetic brush 23 has to be increased in order to provide the same peripheral speed ratio as in the case of counterdirectional. When the magnetic brush 23 is contacted with the drum codirectionally at a low speed, the magnetic particles tend to be deposited on the drum. Accordingly, the peripheral speed ratio is preferably not more than—100%, and in this embodiment, it is—150%.

Figure 2A:
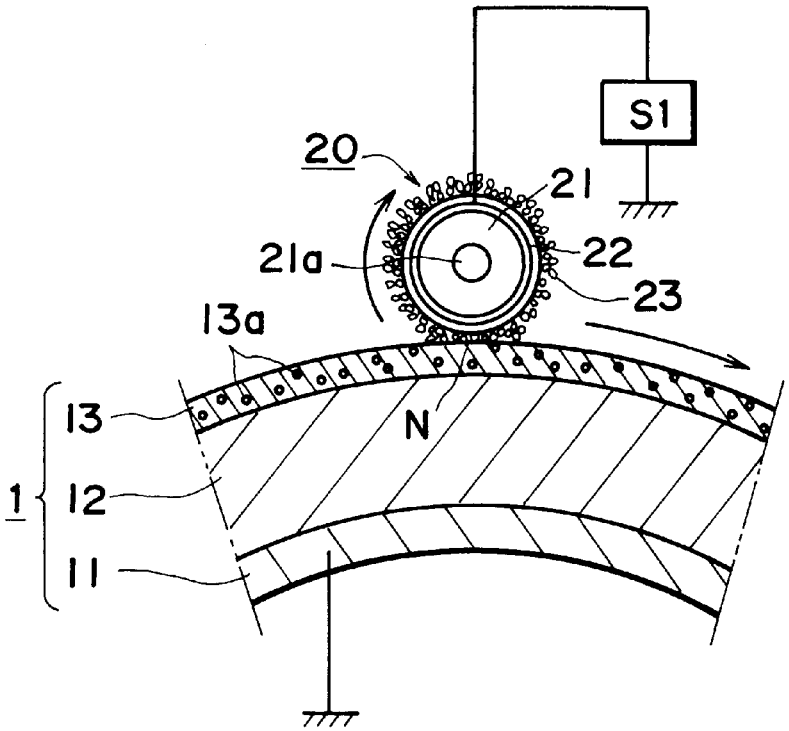
FIGS. 2A and 2B illustrate the principle of injection charging.
Figure 2B:
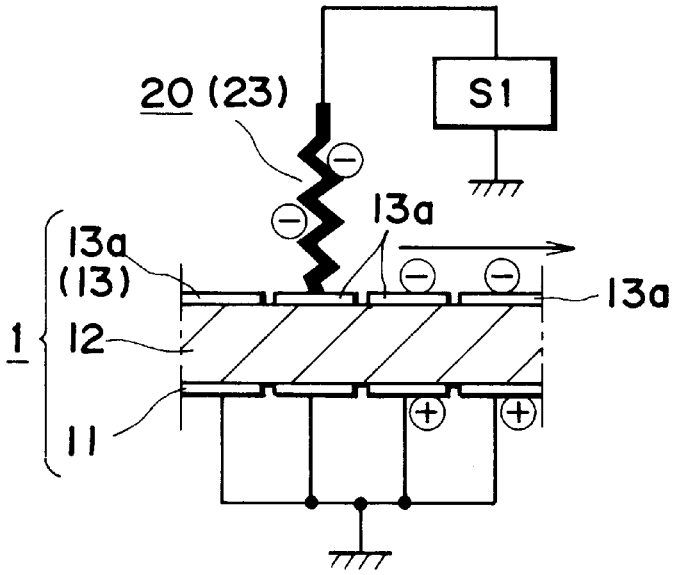

Charging principle (FIGS. 2A and 2B)

Referring to FIG. 2A, the description will be made as to the principle of the charge injection charging. FIG. 2A schematically shows a layer structure of the photosensitive member (drum) 1 as the member to be charged when the magnetic brush type charging member 20 is contacted to the surface, and the voltage is applied, and FIG. 2B shows an equivalent circuit.

Designated by 11 is the aluminum drum base of the drum 1, 12 is the charge transfer layer (fourth layer), 13 is the charge injection layer (fifth layer) at the surface, and 13*a* is the electroconductive particle ($SnO_2$) in the charge injection layer. Between the drum base 11 and the charge transfer layer 12, as described hereinbefore, there are first to third layers, namely primer layer, positive charge injection layer and charge generating layer, but they are omitted in the Figures.

In the charge injection charging, the charge injection is effected to the surface of the member to be charged (photosensitive member) having an intermediate volume resistivity of $1\times10^{9}$–$1\times10^{15}$ Ohm.cm by an intermediate resistance contact charging member 20 of $1\times10^{4}$–$1\times10^{7}$ Ohm. In this embodiment, the charge is supplied to the electroconductive particle 13*a* in the charge injection layer 13 to effect the charging. It is considered that as shown in the equivalent circuit of FIG. 2(*b*), the charge transfer layer 12 functions as a dielectric material, and the contact charging member 20 charges fine capacitors each constituted by electrodes which are aluminum drum base 11 and electroconductive particle 13 as in the charge injection layer 13. Here, the electroconductive particles 13*a* are electrically independent from each other to form a kind of fine float electrode electrodes. Macroscopically, it looks as if the photosensitive member surface is uniformly charged, but actually, a great number of charged fine electroconductive particles ($SnO_2$) would cover the photosensitive member surface. Therefore, when the image exposure is effected, an electrostatic latent image can be retained since the $SnO_2$ particles are electrically independent.

Magnetic particle

As for examples the magnetic particle constituting the magnetic brush 23, the following is considered:

Kneaded mixture of resin material and the magnetic powder members such as magnetite is formed into particles, or the one further mixed with electroconductive carbon or the like for the purpose of resistance value control;

Sintered magnetite or ferrite, or the one deoxidized or oxidized for the purpose of control of resistance value.

The above magnetic particles coated with resistance-adjusted coating material (for example, carbon dispersed in the phenolic resin), or plated with metal to adjust the resistance value to a proper level.

As for the resistance value of the magnetic particle, the charge is not uniformly injected into the drum as the member to be charged, if it is too high, with the result of a fog image. If it is too high, and if the drum surface has a pin hole, the current flows concentratedly at the pin hole with the result of the voltage drop, and therefore, the charging defect in the form of the charging nip. In consideration of the foregoing, the resistance value of the magnetic particle is preferably $1\times10^{4}$–$1\times10^{12}$ Ohm. The resistance value of the magnetic particle was measured as follows; 2 g of magnetic particles was placed in a metal cell (bottom area of 227 $mm^2$) to which a voltage was applicable, and the magnetic particles were pressed with the pressure of 6.6 $kg/cm^2$, and then, the voltage of 1–1000 V was applied.

As for the magnetic property of the magnetic particle, the magnetic confining force for preventing the magnetic particles from depositing on the drum is preferably high, and therefore, or larger saturation magnetization of 50 ($A.m^2/kg$) is desirable.

The magnetic particles actually used in this embodiment have an average particle size of 30 microns, resistance value of $1\times10^{6}$ Ohm and saturation magnetization of 58 ($A.m^2/kg$).

Figure 3:
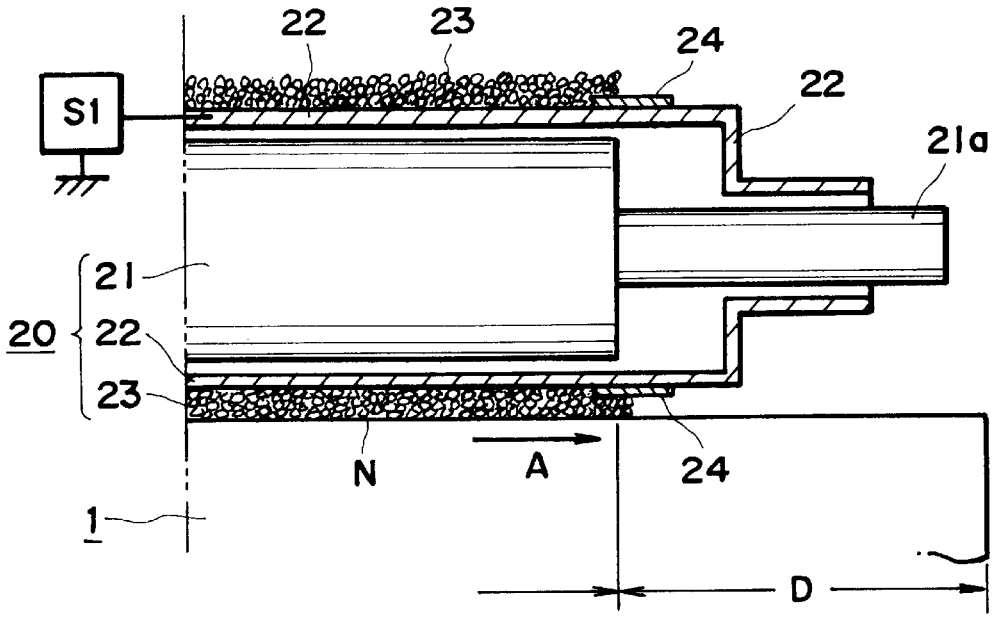
FIG. 3 is a longitudinal schematic view of an end portion of a magnetic brush type charging member according to an embodiment 1.

Electrode sleeve 22 (FIG. 3)

FIG. 3 is a schematic a longitudinal section at an end of the charging member 20. In this embodiment, an annular (ring-like) polyester tape having a thickness of 50 microns is bonded on the outer peripheral surface adjacent a longitudinal end portion (the neighborhood corresponding to the end portion of the magnet roller 21) of the electrode sleeve 22 which is an electric energy supply portion for the magnetic brush 23 of the charging member 20. In this manner, an annular insulation portion 24 is provided. The same applies to the other end portion of the electrode sleeve 22, although not shown in FIG. 3.

The insulation portion 24 is suffice if it extends from an inside of the end portion including a proper degree of margin to the position where the magnetic particles are pushed out by the charging nip portion N. In this embodiment, the 20 mm width range from 5 mm inside of the longitudinal direction end portion of the charging member is constituted as the insulation portion 24.

The degree of the inside margin of the insulation portion 24 is different depending on the resistance of the magnetic particle. When the resistance of the magnetic particle is low, the current through the magnetic particle tends to be large so that the potential of the magnetic particle contacted to the photosensitive member is not so attenuated. Therefore, the potential of the magnetic particle at the magnetic brush end portion is not low enough with the result that it is deposited onto the photosensitive member due to the charge injected to the magnetic particle and the electric field formed by the potential provided thereby. For this reason, the length of the insulation portion in the magnetic brush is preferably long. On the other hand, if the resistance of the magnetic particle is high, the potential of the magnetic particle contacted to the photosensitive member tends to be attenuated by the resistance of the magnetic particle, so that the length of the insulation portion in the magnetic brush can be shortened. Therefore, the length of the insulation portion in the magnetic brush, is preferably determined in accordance with the resistance of the magnetic particle.

Conventionally, the magnetic particles pushed out to the outward region D which is a non-charged region where the surface of the drum (photosensitive member) is not at the charged potential, are deposited to the surface of the drum 1 by the electrical force due to the charge injected into the magnetic particle, in the charging nip portion N. By the use of the above described structure, the electroconductive path between the magnetic particles and the electrode sleeve 22, is broken, so as to prevent injection of the charge into the magnetic particle, and therefore, the deposition of the magnetic particle on the surface of the drum 1 could be prevented.

In this embodiment, the insulation portion 24 is provided by sticking a polyester tape, but another structure is usable. For example, the sleeve may be coated by urethane, acrylic, phenol or another insulative resin material material may be applied. The same advantageous effect could be provided when the sleeve is capped with an insulative resin cap in the form of a ring of polycarbonate.

Figure 4:
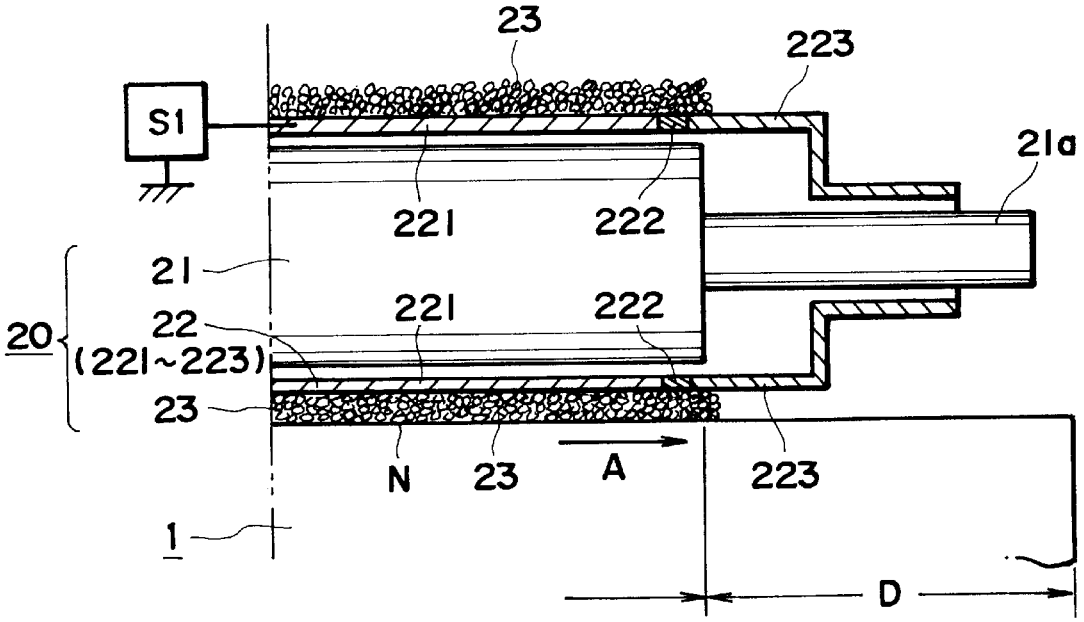
FIG. 4 is a longitudinal schematic view of an end portion of a magnetic brush type charging member according to an embodiment 1.
Figure 5:
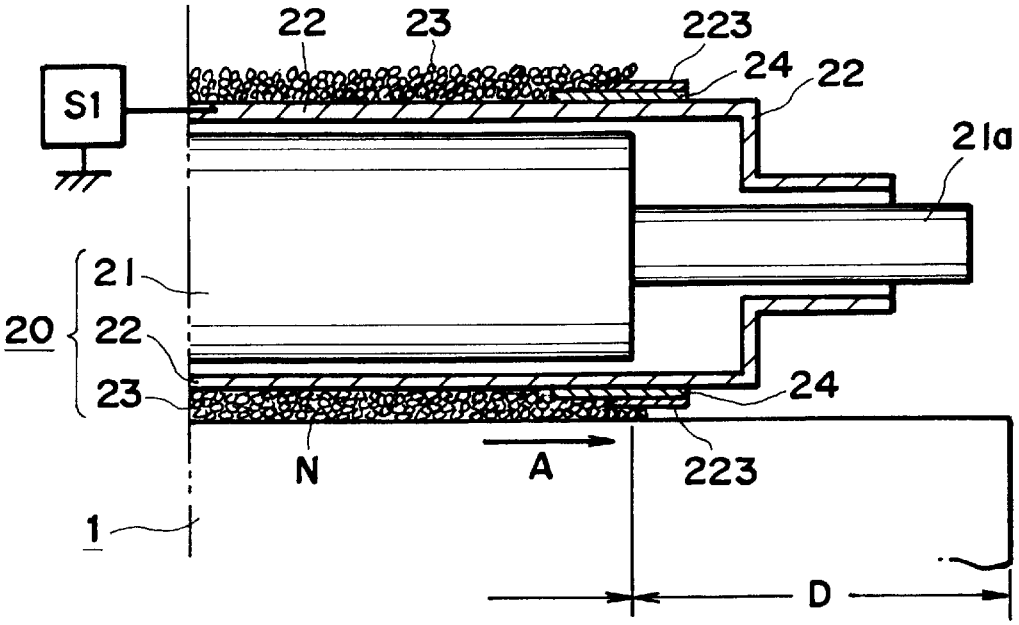
FIG. 5 is a longitudinal schematic view of an end portion of a modified charging member according to an embodiment 2.

Embodiment 2 (FIGS. 4 and 5)

Another embodiment of the charging member will be described.

The feature of this embodiment is in that the portion corresponding to magnetic brush end portion is float electrode portion 223. By this, the potential difference between the magnetic particle and the drum surface can be eliminated, so the deposition, on to the drum, of the magnetic particles pushed out to the longitudinal end portion can be avoided.

As shown in FIG. 4, the electrode sleeve 22 is constituted, from the longitudinal direction end portion, by a float electrode portion 223 of aluminum, an insulation portion 222 of polycarbonate and electric energy supply portion 221 of aluminum for supplying electric energy to the magnetic brush. In the other respects, the structures are the same as with embodiment 1. If the width of the insulation portion 222 is too small, the potential of the electrode portion 223 becomes close to the electrode sleeve 22 through the magnetic particles 23, with the result that the float electrode is not sufficiently floated. In this embodiment, the width of the insulation portion 222 is limited to 5 mm. This width is preferably changed in accordance with the resistance of the magnetic particle. More particularly, it is increased with the decrease of the resistance.

In the foregoing embodiment 1, the portion of the electrode sleeve 22 corresponding to the end portion of the magnetic brush 23 is formed as insulation portion 24, and therefore, the insulation portion 24 may locally obtain a potential due to the turboelectric charge with magnetic particle, with the result that a potential difference is formed between the insulation portion 24 and the photosensitive member surface. If this occurs, the magnetic particles may be deposited onto the drum 1. In this embodiment, the float electrode portion 223 is provided as a separate electrode from the electric energy supply portion 221 at the electrode sleeve end portion, so that the local potential due to the turboelectric charge with the magnetic particles can be reduced. The potential of the magnetic particle at the end portion of the magnetic brush 23 is substantially the same as the drum 1. Thus, the injection of the charge into the magnetic particle, can be avoided so that the deposition of the magnetic particle to the drum can be avoided.

The structure of the float electrode portion 223 is not limited to the that shown in FIG. 4, but as shown in FIG. 5, a float electrode portion 223 can be formed on the surface of the electrode sleeve 22 with one layer of insulating material 24 therebetween. Here, to assure the insulativeness, the insulation portion 24 is made longer beyond electrode portion 223 in the longitudinal direction toward the longitudinal center by 5 mm approx. The insulation layer 24 is formed in the same manner as in embodiment 1, and the float electrode portion 223 may be formed by dip-coating the electroconductive paint such as urethane or the like in which carbon is dispersed on the insulation layer 24, or may be formed by bonding or sticking an electroconductive tape, with the same advantageous effects.

Embodiment 3

This embodiment is advantageous in the magnetic particle deposition prevention onto the drum when AC voltage application is made to the magnetic brush.

The charging with the use of magnetic brush can be effected with the DC potential application since the potential applied to the charging member can be given as it is to the drum.

This embodiment is particularly effective in the cleanerless process without the use of cleaning device 6 shown in FIG. 1.

In this process, the drum cleaner is omitted, and therefore, the residual toner may be mixed into the charger, but the contact of the magnetic particles is very stable, and therefore, the introduced toner can be removed in the charger, and the toner can be returned to the drum, so that the repeated printing operation is possible. It is preferable finally to remove the residual toner by the developing device 3 during the development operation. At this time, in order to avoid the influence of the toner, the magnetic brush may be supplied with a bias voltage to which an AC voltage is superposed. When the AC voltage is superposed, a potential difference which Is larger than the case of the DC voltage application is produced between the charging member (sleeve) and the drum, and therefore, disadvantage arises in connection with the deposition of the magnetic particle s.

Figure 6:
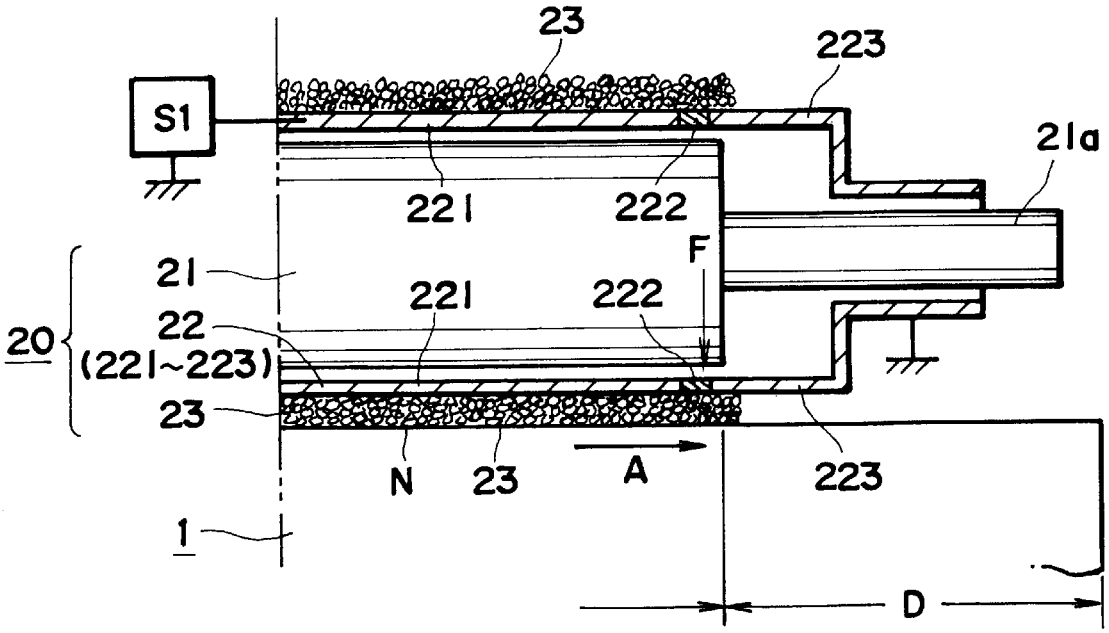
FIG. 6 is a longitudinal schematic view of an end portion of a magnetic brush type charging member according to embodiment 3.

It is desirable that the potential difference between the end portion of the magnetic brush and the drum is eliminated, thus reducing the deposition of the magnetic particle to the drum from the magnetic brush. In the cleanerless process, if the use is made with the charging device of FIG. 3, the magnetic brush end portion and the drum are electrically isolated by the provision of the annular insulation layer 24 on the sleeve at the magnetic brush end portion, thus reducing the deposition of the magnetic particle onto the drum. In the cleanerless process, if the use is made with the charging device, the deposition of the magnetic particle can be further reduced by mounting the electrode portion 223 through the insulation layer 222 at the magnetic brush end portion. However, with this structure, the potential of structure of the magnetic brush gradually increases with continuous operation. Therefore, in the long term use, a small amount of magnetic particles may be deposited on the drum. As shown in FIG. 6, the electrode portion 223 is made common with the drum ground, and then, the deposition can be avoided. By electrically grounding the electrode portion 223, the potential of the magnetic brush decreases toward the end portion. The final potential is close to the drum ground, the potential difference between the magnetic brush and the drum (the drum surface not contacted with the brush) is substantially eliminated. Therefore, even if the charging operation is continued, no potential difference and therefore no deposition is produced.

Figure 7:
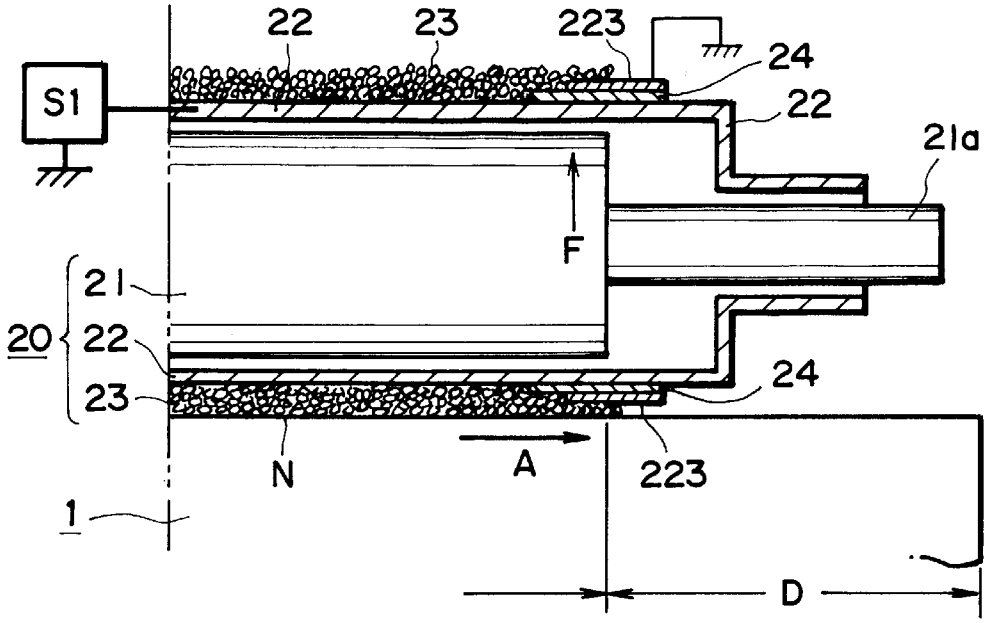
FIG. 7 shows a modification of embodiment 3.

The same applies to the structure of FIG. 7, and the insulation layer 24 is sandwiched between the sleeve 22 and electrode 223, and the potential is made common with the drum ground, by which the deposition of the magnetic particles can be avoided.

The detailed description will be made as to the position relation between the brush end portion and the electrode portion in FIGS. 6 and 7. In this embodiment, the dimensions have drum diameter of 30 mm, sleeve diameter of 16 mm and a gap between the drum and sleeve of 0.5 mm. In the region of brush extreme end portion 3–5 mm, the magnetic particles are sparse, and therefore, they are easily influenced by the electric field, and it is preferable to set the end portion electrode boundary (FIGS. 6 and 7, F) at a position at least not less than 5 mm from the magnetic brush extreme end portion.

With this structure, the deposition at the magnetic brush end portion can be prevented even if the AC voltage is superposed on the DC voltage.

The charging devices of FIGS. 6 and 7 is usable when the charging member is supplied with DC voltage only without AC voltage.

Embodiment 4

In this embodiment, the surface of the drum at the position corresponding to the magnetic brush end portion is formed by an electroconductive member (electrode portion) 101. The electrode portion 101 is contacted to the end portion of the magnetic brush 23 to have the same potential as the electrode sleeve 22, and therefore, even if the magnetic particles are pushed out to the longitudinally outward region D in the charging nip portion N, no charge is injected into the magnetic particle, and no electrical force is applied, so that the deposition of the magnetic particle onto the drum can be prevented.

Figure 8:
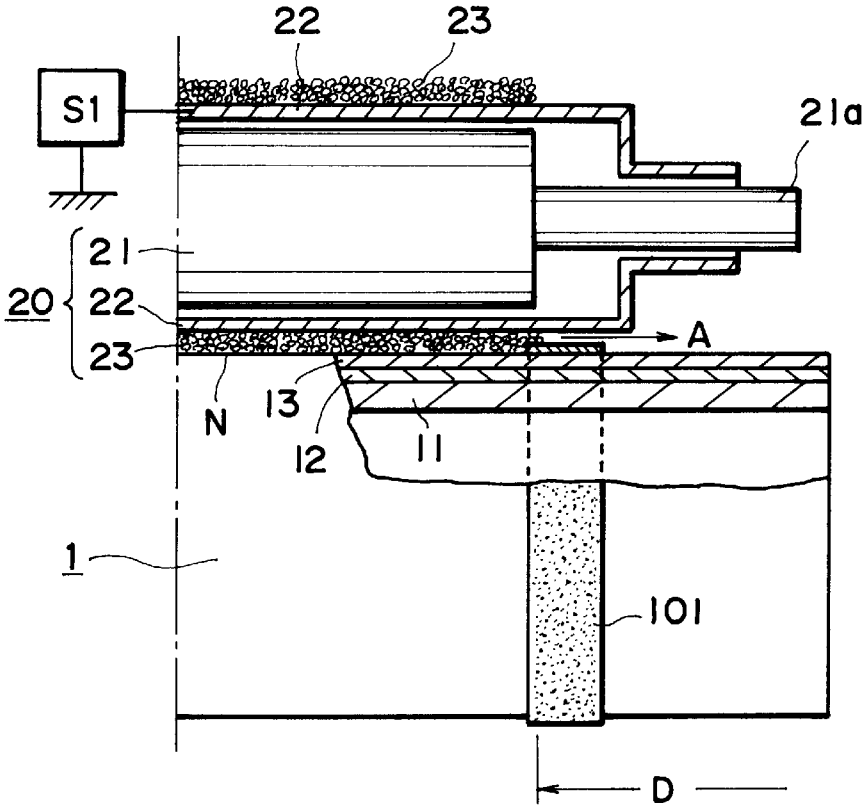
FIG. 8 is a drum and an end portion of magnetic brush type charging member in the device according to embodiment 4.

More particularly, as shown in FIG. 8, the electrode 101 of conductive material is formed at the end portion of the drum 1. The position of the electrode portion 101 is satisfactory if it is the position where the magnetic particles expands to the outward region D in the charging nip portion N from the wide of the magnetic brush 23. To be safe, in this embodiment, the electrode portion 101 is formed from slightly inside of the end portion of magnetic brush 23, and the width is 15 mm. Below the electrode portion 101, there is an insulation layer such as charge transfer layer, and the electrode portion 101 is electrically isolated from the drum base 11. By the provision of the insulation layer of polycarbonate or the like, the layer below the electrode portion 101 is further effective.

In this embodiment, the electrode portion 101 formed by dip-coating of the paint comprising carbon graphite dispersed in acrylic resin material, which has been dried under normal temperature, and it has a thickness of approximately 20 microns. The structure of the electrode portion 101 is not limited to this example. The paint may be any if it is of electroconductive, sliding property relative to the magnetic particle is good, it is not easily scraped, it is dried under the temperature not more than 50° C., preferably, at the normal temperature, the solvent thereof does not contaminate the drum. Except for the acrylic resin material, urethane resin material, phenolic resin or the like is usable. In place of carbon graphite, carbon black, tin oxide or another metal oxide is usable. The coating method may be roller coating method, spray coating method in addition to the dipping.

As for the electroconductive member of the electrode portion 101, metal foil of aluminum, copper or the like may be bonded, a thin layer tube of electroconductive rubber of carbon dispersed EPDM may cover. If the thickness of the electrode portion 101 is too large, the magnetic particle is deposited to the step portion of the electrode portion 101, and therefore, it is preferably small as long as the strength of the electrode portion 101 is assured. From this standpoint, it was most preferable to form the electrode portion 101 through evaporation method. More particularly, the charging region in the longitudinal direction is masked, copper is deposited by vacuum deposition method to the thickness of 0.5 microns while rotating the electrode portion 101. With the evaporation method, the electroconductive electrode can be formed on a silicon drum surface, and therefore, this structure is used for the silicon drum.

By the above described structure, the upper end portion of the drum contacted to the magnetic particles pushed out of the charging nip portion N, is electroconductive, and has the same potential as the magnetic particle, so that the deposition of the magnetic particles on the drum can be prevented. In the foregoing embodiments 1, 2, 3, the electrode sleeve 22 side determines the electrical structure at the longitudinal end portion, and therefore, if the magnetic particles expands to the outside in the longitudinal direction of the charging nip portion N, a small amount of the expanded magnetic particles is deposited onto the drum. According to this embodiment, the end portion adjacent the drum 1 has the same potential as the magnetic brush 23, and therefore, even if the magnetic particles expand, the magnetic particles are not deposited on the drum, since the expanded portion has the same potentials. Even if the device is used for a long term, the magnetic particles do not decrease, so that the charging property is stable.

Designated by 11 is a drum base of aluminum of the drum 1, and 12 is a charge transfer layer (fourth layer), and 13 is a surface charge injection layer (fifth layer). Between the drum base 11 and the charge transfer layer 12, there exists the first to third layers, positive charge injection layer, charge generating layer, but they are omitted in the figure.

The photosensitive member of this embodiment may be used with the charging member of embodiments 1–3.

Embodiment 5

In this embodiment, an electroconductive portion (electrode portion) 102 electrically insulated from the drum base 11 is formed at a drum 1 corresponding to the magnetic brush end portion at the longitudinal end portion of the drum 1 as the member to be charged. By doing so, the electrode portion 102 has the same potential as the magnetic brush 23, so that the magnetic particle is electrically prevented from being deposited to the drum.

Figure 9:
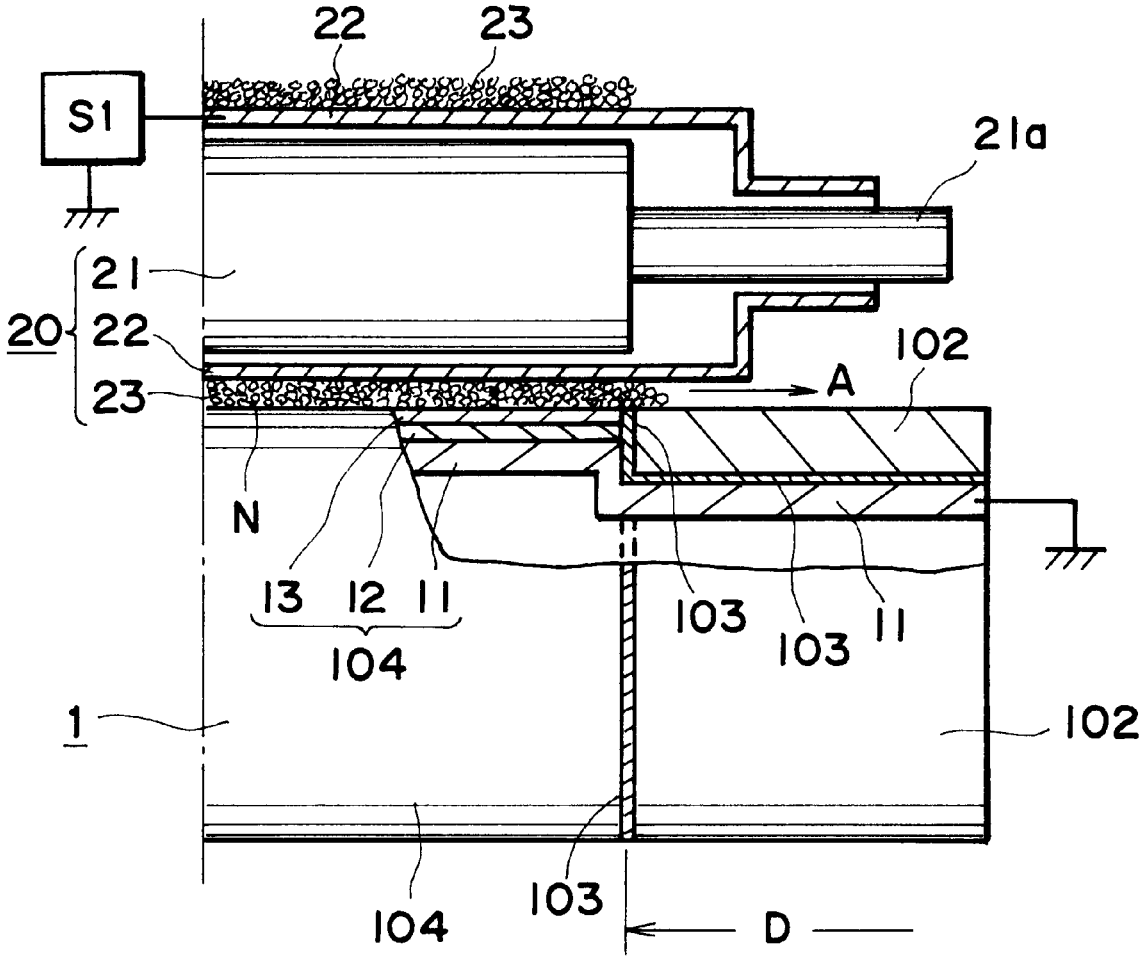
FIG. 9 is a schematic longitudinal section of a drum and an end portion of magnetic brush type charging member in the device according to embodiment 5.

More particularly, as shown in FIG. 9, the drum 1 is constituted by a drum portion 104 comprising an electrode portion 102 of aluminum, an insulation portion 103 of polycarbonate, a charge transfer layer 12, a charge injection layer 13, or the like. The primer layer, positive charge injection layer and charge generating layer are omitted in the Figure. For the grounding, the drum base 11 is of the structure as shown in the Figure.

In the embodiment 4, the electrode portion 101 is relatively easily scraped in the long run, as compared with this embodiment, with the result that a small amount of the magnetic particles are deposited on the drum. However, with the structure of this embodiment, the electrode portion 102 is not lost even if it is more or less scraped. Therefore, the magnetic particle deposition can be avoided in the long run. The magnetic particles do not decrease, so that the good charging property can be maintained. The photosensitive member of this embodiment may be used with the charging member of embodiments 1–3.

Embodiment 6

In this embodiment, the charging member 20 is such that, as shown in FIG. 10A, the magnetic particles are directly deposited to the magnet roller 21A to form a magnetic brush 23, and the magnet roller 21A is rotated. With the combinations of the fixed magnet roller 21 and the rotation electrode sleeve 22, the magnetic flux density tends to decrease in the distance between the magnet roller 21 and the sleeve 22 surface. However, by depositing the magnetic particles directly on the magnet roller 21A surface to form the magnetic brush 23, the deposition of the magnetic particle to the drum can be significantly improved.

The magnet roller 21A used had a diameter of 15 mm, and has 8 magnetic poles, and the maximum magnetic flux density on the roller surface was 1500 Gauss. The height of the chains of the magnetic particles is limited by a magnetic plate to 1.5 mm, and the gap between the magnet roller 21A and the drum 1 is maintained at 500 microns by rollers.

The end portion of the magnet roller 21A is sealed by a seal member 26 so as to prevent the magnetic particles from expanding outwardly in the longitudinal direction. In FIG. 10A, the magnetic particles of the magnetic brush 23 are present all over the circumference of the magnet roller 21A between the seal member 26 and the magnet roller 21A, but actually, the magnetic particles do not exist where the seal member 26 is present. The seal member 26 is inclined toward inside in the longitudinal direction, as shown in FIG. 10B in the rotational direction of the magnet roller to prevent the expansion of the magnetic particle, by which the magnetic particle are returned to the inside (arrow E), and therefore, this is preferable. As for the magnetic particle, 15 g of the magnetic particle of embodiment 1 was used. The device was the same as of embodiment 1 except for the charging member 20.

The magnet roller 21A used in this embodiment is of insulation member, and the roller 21A surface is made conductive (27) to apply a voltage to the magnetic brush 23. As for the method of making it conductive, as shown in (c), the longitudinally inside portion from the end portion of the magnetic brush 23 regulated by the seal member 26 was made conductive. By doing so, the end portion of the magnet roller 21A is insulative, so that even if the magnetic brush 23 expands outwardly at the charging nip portion N, the electroconductive path for the charge is cut, and therefore, the charge is not injected into the magnetic particle. Thus, the deposition of the magnetic particle to the drum is prevented.

As for the specific method for making the surface of the magnet roller 21A conductive, only the end portion of the roller is masked, and the dip coating on the electroconductive paint is effected. The electroconductive paint used here is subjected to the resistance lowering treatment by dispersing carbon graphite in the urethane.

In this embodiment, the end portion of the magnetic brush 23 is regulated by a seal member 26, so that the magnetic confining force acts on the outside of the magnetic brush 23. Therefore, as compared with the embodiment 1, the magnetic particles of the magnetic brush 23 tends to expand in the charging nip portion N in the easy. However, by the structure described above, the deposition of the magnetic particle of the magnetic brush 23 on the drum can be significantly prevented. The deposition of the magnetic particles can be further prevented by using the electroconductive portion 101, 102 on the surface at the end portion of the drum as described in embodiments 4, 5. Thus, good charging property can be maintained in the long run operation.

This structure is taken since the magnet roller 21A used in this embodiment is an insulation member. When the use is made with the conductive magnet, the longitudinal end portion of the magnet may be of insulation member 24 as in the end portion of the electrode sleeve 22 in embodiment 1, with the same advantageous effects.

All of the above-described magnetic brush type contact charging members may of of the type using a rotation endless belt member. It may be a non-rotatable rod, square bar, elongated plate or the like.

Embodiment 7 (FIGS. 11A, 11B, 12A and 12C)

In embodiments 7–9, the charging device 2 comprises a first charging member 20 and second charging member (elastic member) 40. The structure except for the charging device in the image forming apparatus is the same as of 1, and the detailed description is omitted.

Figure 11A:
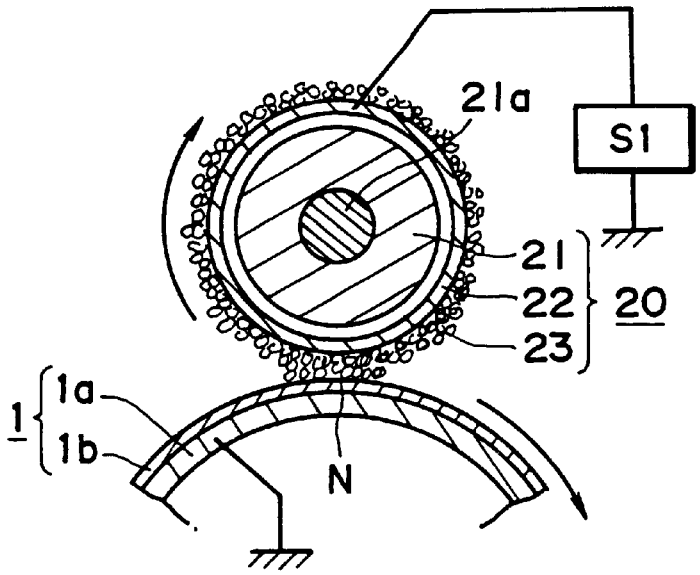
FIG. 11A is a side sectional view of a first charging member according to embodiment 7.
Figure 11B:
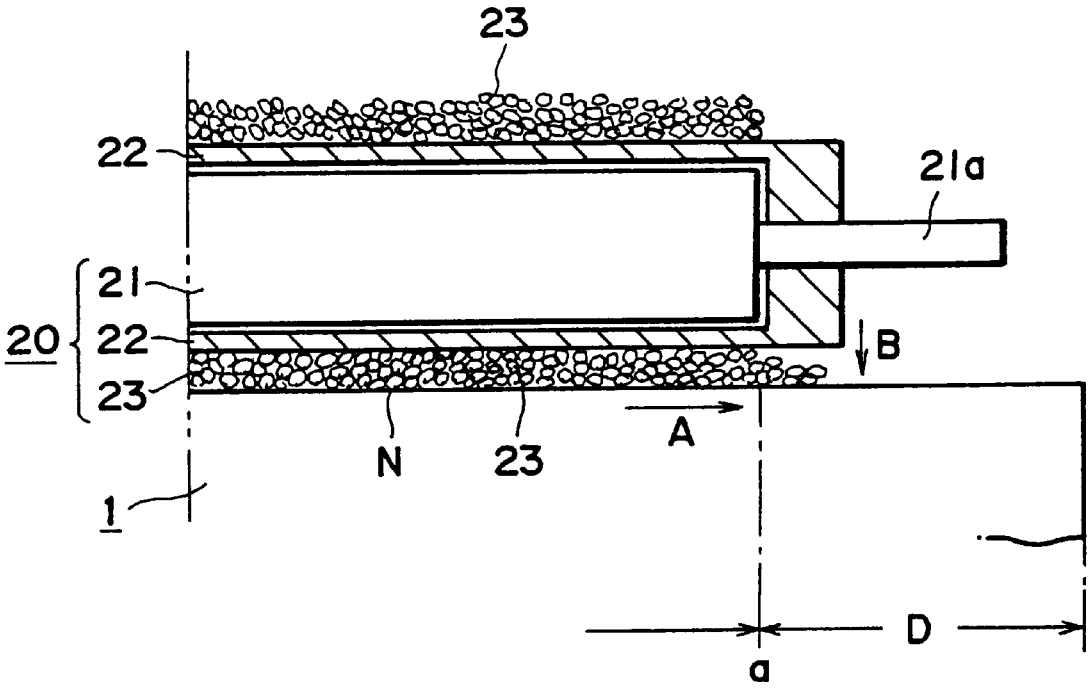
FIG. 11B is a front sectional view of a first charging member.
Figure 12A:
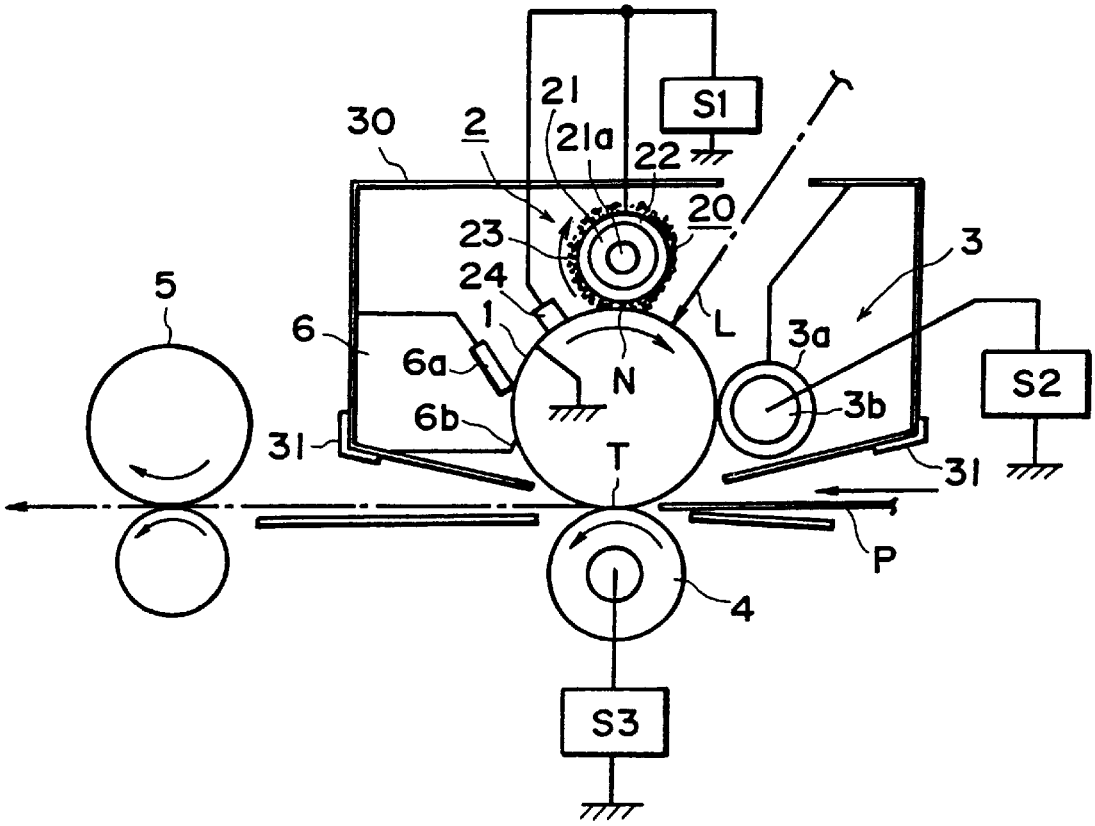
FIG. 12A illustrates an image forming apparatus according to embodiment 7.
Figure 12B:
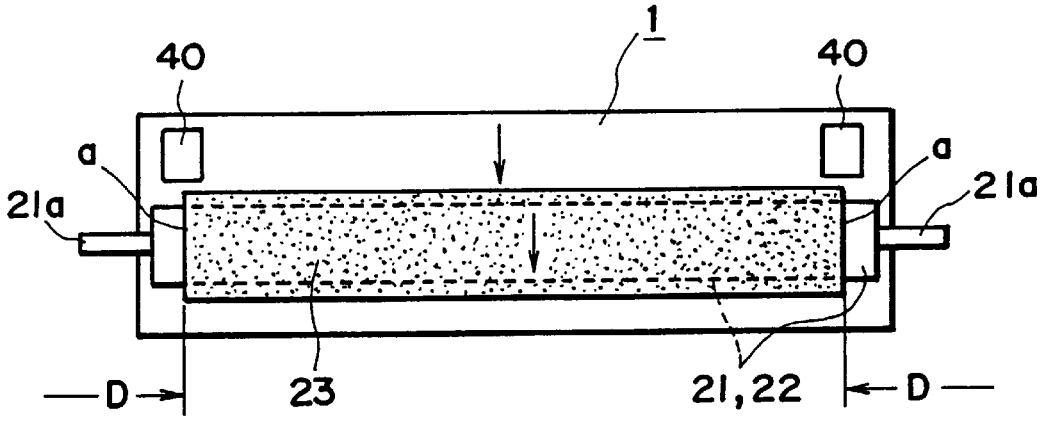
FIG. 12B is a schematic plan view of a charging member portion.

FIG. 11A is a side sectional view of the first charging member 20, and FIG. 11B a front sectional view thereof, and FIG. 12A is a side sectional view, and FIG. 12B is a plan view of the charging device. The charging member 20 is the same as that of the embodiment 1 except for the structure of the charging member and the structure (without the insulation portion 24 in the charging member of FIG. 3), and the detailed description is omitted.

The printer of this embodiment is a process cartridge type using a cartridge 30, detachably mountable to the main assembly of printer, the cartridge 30 contains the drum 1, the charging device 2, the first and second contact charging members 20, 40, developing device 3 and cleaning device 6 (four process means).

Precharger 40

The second charging member 40, as shown in FIG. 12, is contacted to the drum at a position corresponding to the longitudinal end portion of the magnetic brush 23 of the charging member 20 upstream of the magnetic brush type contact charging member 20 as the first charging member with respect to the rotational direction (movement direction) of the drum 1, more particularly between the cleaning device 6 and the first charging member 20.

The second charging member 40 is of electroconductive sponge (elastic member) in this embodiment. To the second charging member 40, the same voltage as applied to the electrode sleeve 22 of the magnetic brush type charging member 20 is applied from the charging bias application voltage source Sl. The electric energy supply timing for the second charging member 40, is earlier corresponding to the positional difference between the second charging member 40 and the first charging member 20.

The second charging member 40 charges, to the same potential as the surface of the drum to be charged by the first charging member 20, the surface corresponding to the longitudinal end portion of the magnetic brush 23 of the magnetic brush type charging member 20. The longitudinal region charged by the second charging member 40 is from 5 mm approximately inside to the region (20 mm outside the position a) where the magnetic particles pushed out by the charging nip portion N of the first charging member 20 may extend, more particularly total 25 mm, including end margin.

With this structure, the portion of the surface of drum corresponding to the magnetic brush end portion of the region of the surface of the drum to be charged by the first charging member 20, is charged beforehand to the same portion as the surface of the drum provided by the first charging member 20, and therefore, this portion has the same potential as the magnetic particles, so that the deposition of the magnetic particles on the drum 1 can be avoided. Accordingly, the amount of the magnetic particles 23 does not decrease, and therefore, stable charging property can be provided even in the continuous operation.

The electroconductive sponge 40 of the second charging member is of EPDM foamed member having an adjusted resistance value of $1\times10^6$ Ohm.cm, but this is not limiting, and foamed members of urethane, silicone rubber, NBR, EPH, CR, SBR or the like in which carbon or metal oxide as electroconductive material is dispersed is usable.

The second charging member 40 may be a solid rubber, for example, not an elastic member as sponge. However, the elastic member such as sponge is preferable since then the contact with the drum 1 is stable, and therefore, the uniform injection of charge is accomplished.

In this embodiment, as the elastic member of the second charging member 40, sponge is used. Felt having an intermediate resistance is usable with the same advantage.

Figure 13:
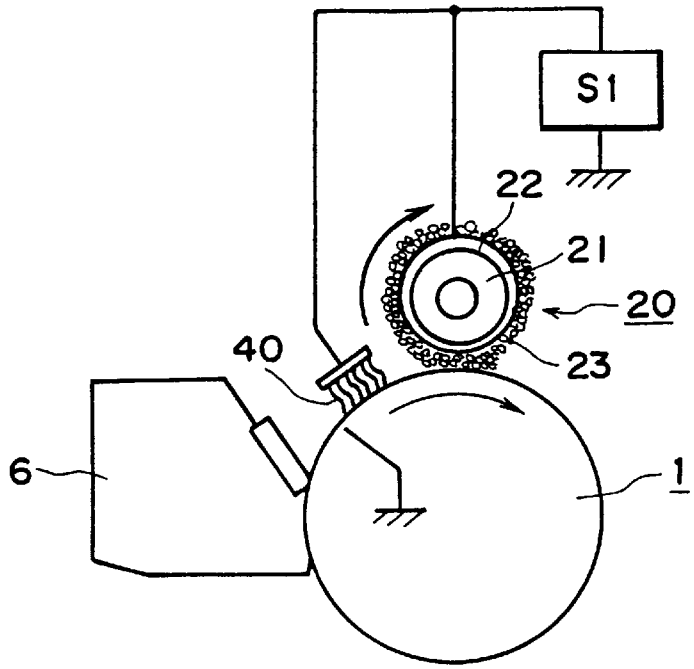
FIG. 13 is an embodiment of side surface of a major part of charging device according to embodiment 8.

Embodiment 8 (FIG. 13)

This embodiment is a modification of the foregoing embodiment 7, and the use is made with furbrush as the second charging member 40. The other structures are the same as embodiment 7. The furbrush 40 is of fibers of rayon in which carbon is dispersed, and has a resistance value of $5\times10^6$ Ohm.cm, 300 denier/50 filaments and a density of 155 per 1 square.

The material of the furbrush may be REC-B, REC-C, REC-M1, REC-M10 available from YUNICHIKA KABUSHIKI KAISHA, Japan, CLACARBO available from TORAY KABUSHIKI KAISHA, carbon dispersed rayon, or ROVAL available from MITSUBISHI RAYON KABUSHIKI KAISHA or the like. From the standpoint of the stability against ambient condition change, REC-B, REC-C, REC-M1, REC-M10 available from YUNICHIKA KABUSHIKI KAISHA is desirable.

The same advantageous effects as in embodiment 7 are provided in this embodiment. Since the second charging member 40 is of furbrush, the contact with the drum 1 is soft, and therefore, the torque required can be reduced.

Figure 14A:
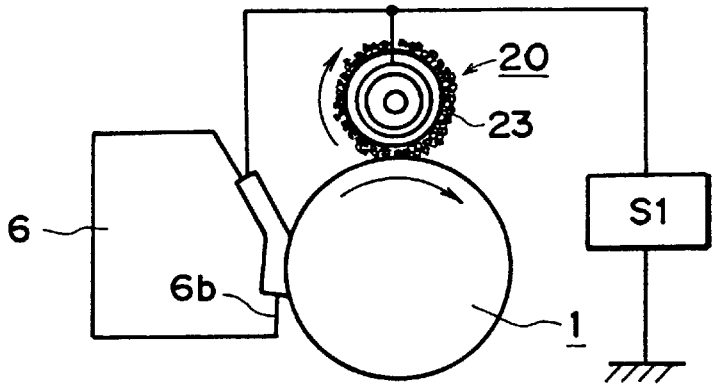
FIG. 14A is a schematic view of side surface of major part of charging device according to embodiment 9.
Figure 14B:
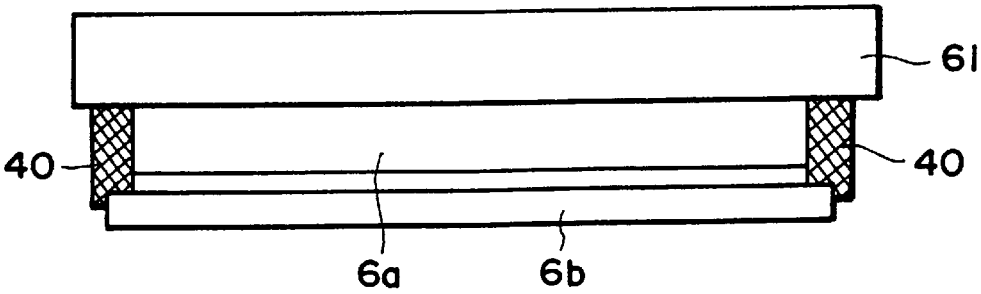
FIG. 14B is a schematic front view showing a position relation of a second charging member used also as end seal member, cleaning blade and receptor sheet of cleaning device.

Embodiment 9 (FIGS. 14A and 14B)

In this embodiment, the charging member 40 is provided with an end portion seal member for sealing to prevent the toner from leaking at an end portion of the cleaning device 6. The second charging member 40 with the sealing structure is of electroconductive sponge, and is contacted to a position ((a) in FIG. 12B) of the drum corresponding to the longitudinal end portion of the magnetic brush 23 of the magnetic brush type charging member 20 functioning as the first charging member. More particularly, as shown in in FIG. 14B, an electroconductive sponge 40 as a second charging member functioning also as end portion seal member is provided at each of the longitudinal end of the cleaning device blade 6*a* of urethane supported on the blade supporting member 61 of the cleaning device 6. A receptor sheet 6*b* for receiving the toner removed by the cleaning means is partly overlapped with the the electroconductive sponge 40.

The electroconductive sponge 40 used in this embodiment, is EPDM foamed member in which carbon dispersion is dispersed, namely, the same as used in embodiment 7. The furbrush used in embodiment 8 is usable, but in this case, a high density material is desirable to prevent the leakage of the toner. The similar effect can be provided with the use of electroconductive felt, textile or the like.

With this structure, similarly to embodiments 7, 8, the surface of the embodiment at the longitudinal end portion, is charged beforehand to the same potential as the first charging member by the electroconductive sponge 40 functioning also as the end portion seal for the cleaning device 6. Therefore, the portion of the drum corresponding to the longitudinal end portion (b), has the same potential as the magnetic particles, thus preventing deposition of the magnetic particles on the drum.

With the structure of this embodiment, second charging member 40 functions also as the end portion seal of the cleaning device 6, and therefore, there is no need of providing an additional space for the second charging member 40, thus accomplishing the device downsizing. The first charging member may be the charging member in embodiments 1–3, 6. The photosensitive member may be the same as embodiments 4, 5.

The magnetic brush type charging member 20 as the first charging member in embodiments 7–9, may be of endless belt member. It may be a rod, square bar, elongated plate or the like. The magnetic brush 23 may be formed by directly attracting the magnetic particles to magnet member having a surface made conductive. The second charging member 40 may be a rotation member.

The first charging member of embodiments 7–9 may be the charging member in embodiments 1–3, 6. The photosensitive member in embodiments 7–9 may be the one in embodiments 4, 5.

Figure 15:
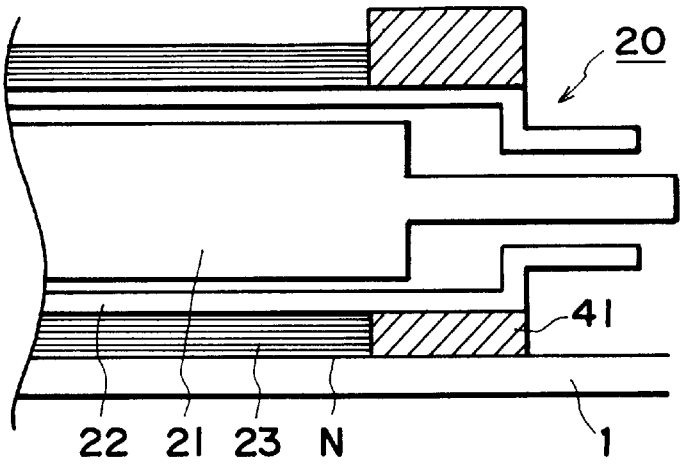
FIG. 15 is an a longitudinal section Figure showing a configuration of a longitudinal end of the charging member according to embodiment 10.

Embodiment 10 (FIG. 15)

Another example of the charging device will be described. In embodiment 10–13, an elastic member is provided at longitudinal direction end portions of the charging member as a charging member. The structure of the image forming apparatus except for the charging device is the same as in embodiment 1, and therefore, the detailed description is omitted for simplicity.

Referring to FIG. 15, the end portion of the charging member in this embodiment will be described. FIG. 15 is a longitudinal sectional view of the charging member 20, an electroconductive sponge portion (elastic member) 41 is provided at the longitudinal direction end portion of the charging sleeve 22 (end portion of magnet 22). In this Figure, only one end is shown, the sponge 41 is provided also at the other end. The outer diameter of the sponge portion 41 is larger by 2 mm than the outer diameter of 16mm of the charging sleeve 22 to provide a nip sufficient for charging. Since, it is pressurized to maintain the gap between the photosensitive member 1 and the sleeve 22, so that it has a radius of 8.5 mm at the contact portion. The contact with the photosensitive member 1 is stabilized to accomplish the uniform injection of charge when the sponge portion 41 is of elastic member such as sponge than when it is of solid rubber, for example. In other words, by the use of the elastic member 41, it can be uniformly contacted with the photosensitive member 1 to permit uniform injection of the charge. Here, the used sponge is EPDM foamed member having adjusted resistance value of $1\times10^6$ Ohm.cm by carbon dispersion, but this is not limiting, and the electroconductive material may be of carbon or metal oxide dispersed urethane, silicone rubber, NBR, EPM, CR, SBR or the like foamed member.

With the above described structure, the longitudinal direction end portion of the charging member 20 is charged by the electroconductive sponge portion 41, and therefore, the photosensitive member 1 is charged to the same potential as the magnetic particle 23, so that the deposition of the magnetic particle 23 to the photosensitive member 1 can be prevented. The sponge portion 41 functions also as a seal for the magnetic particle 23*s*, so that the magnetic particles 23 are not easily moved to the longitudinally outward portions in the charging nip N. Thus, the decrease of the magnetic particle 23 can be prevented, thus accomplishing stable charging property even in the long term use.

In this embodiment, the elastic member is of sponge, but the same effect is provided with the use of the intermediate felt.

Figure 16:
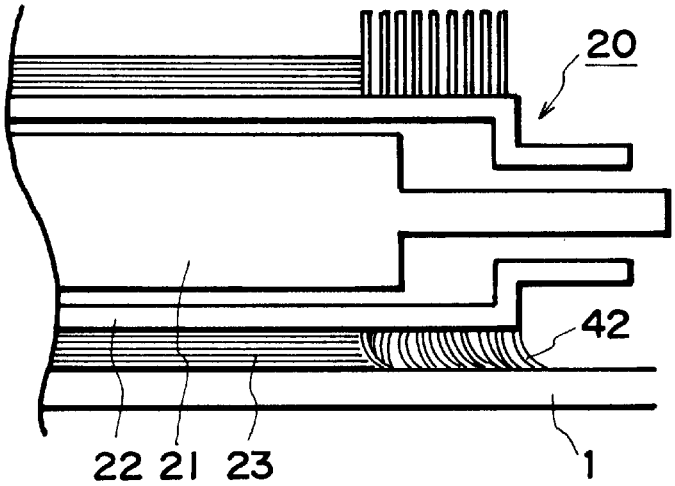
FIG. 16 is an a longitudinal section Figure showing a configuration of a longitudinal end of a charging member according to embodiment 10.

Embodiment 11 (FIG. 16)

In this embodiment, an end portion of a magnetic brush, namely, the end portion of the charging sleeve is of furbrush.

More particularly, as shown in FIG. 16, the end portion of the charging sleeve 22 is provided with furbrush 42 comprising fibers of carbon dispersed rayon. The furbrush 42 has a resistance value of $5\times10^6$ Ohm.cm, 300 denier/50 filament, and the number thereof is 155 the present per 1 mm square.

The material of the furbrush is of REC-B, REC-C, REC-M1, REC-M10 available from YUNICHIKA KABUSHIKI KAISHA, SA-7 available from TORAY KABUSHIKI KAISHA, THUNDERRON available from NIHON SANO KABUSHIKI KAISHA, BELLTRON available from KANEBO KABUSHIKI KAISHA, CLACARBO available from KURARE KABUSHIKI KAISHA, a carbon dispersed rayon, ROBAL available from MITSUBISHI RAYON KABUSHIKI KAISHA KABUSHIKI KAISHA, or the like. From the standpoint of ambience stable property, REC-B, REC-C, REC-M1, REC-M10 available from YUNICHIKA KABUSHIKI KAISHA is desirable from the standpoint of the stability against ambient condition change.

With this structure, the outer longitudinal direction end portion of the charging member 2 is charged by the furbrush 42, and therefore, the photosensitive member 1 has the same potential as the magnetic particle 23, thus preventing deposition of the magnetic particles 23 on the photosensitive member 1. Therefore, the decreasing of the magnetic particles 23 of the magnetic brush can be avoided, so that the charging property is stable in the long term use.

By the use of furbrush 42, the contact with c is soft, so that the required torque is reduced.

Figure 17:
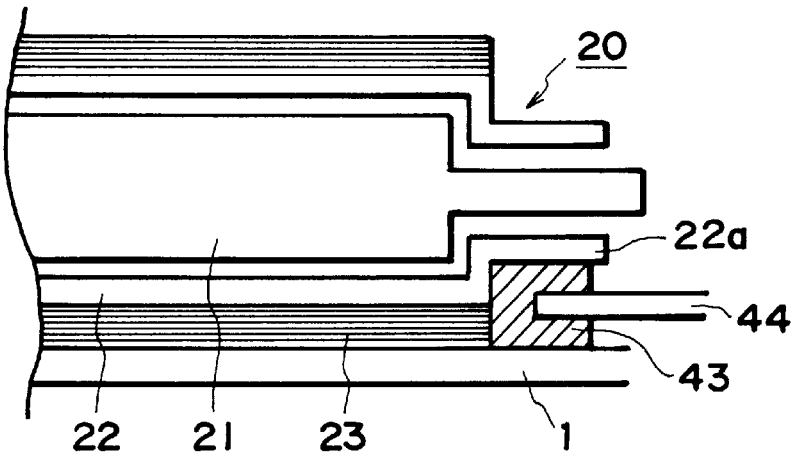
FIG. 17 is an a longitudinal section Figure showing an embodiment of a longitudinal end of a charging member according to embodiment 11.

Embodiment 12 (FIG. 17)

In this embodiment, the portion of the charging member corresponding to the image area of the photosensitive member is of magnetic brush, and the end portion is provided with a fixed electroconductive sponge (non-rotatable).

FIG. 17 shows specific structure. The electroconductive sponge 43 is fixed to the supporting member 44, so that it has the same potential as the magnetic particle supplying electricity by contact with the charging sleeve 22, and therefore, it charges the photosensitive member 1. The electroconductive sponge 43 used in this embodiment, the EPDM foamed member used in embodiment 10. The electroconductive sponge 43 may be a fur brush 42 used in embodiment 11.

With this structure, similarly to embodiments 10, 11, the outer longitudinal end portions of the charging member 2 are charged by the electroconductive sponge 43, so that the photosensitive member has the same potential as magnetic particle 23, thus avoiding deposition of the magnetic particles 23 onto the photosensitive member 1. In embodiment 10, and embodiment 11, the elastic member such as sponge portion 41 or furbrush 42 at the end portion is rotated as an unit with the magnetic brush. The magnetic particles 23 may be deposited on the surface of the elastic member at a position away from the charging nip. Then, when the photosensitive member 1 and the charging nip are next contacted with earth other, the magnetic particles 23 may enter between the photosensitive member 1 and the elastic member. If this occurs, the surface of the photosensitive member 1 may be damaged. With the structure of this embodiment, the same surface is always in contact with he photosensitive member. Therefore, the magnetic article 23 not enter there. Thus, the damage to he photosensitive member 1 can be reduced.

Thus, the magnetic particles 23 of the magnetic brush does not reduce, so that the stable charging property can be provided in the long term use, and the damage to the photosensitive member 1 can be prevented.

Embodiment 13

In this embodiment, the portion of the charging member corresponding to the image area of the photosensitive member is formed by a magnetic brush, and the end portion is of electroconductive sponge, which is rotatable independently of the magnetic brush.

Figure 18:
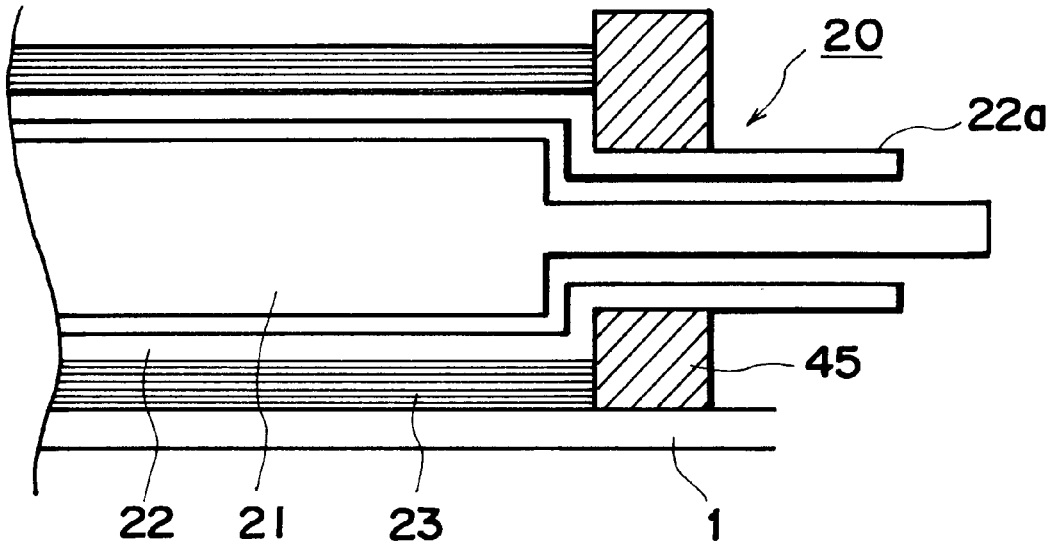
FIG. 18 is an a longitudinal section Figure showing an embodiment of a longitudinal end of a charging member according to embodiment 12.
Figure 19:
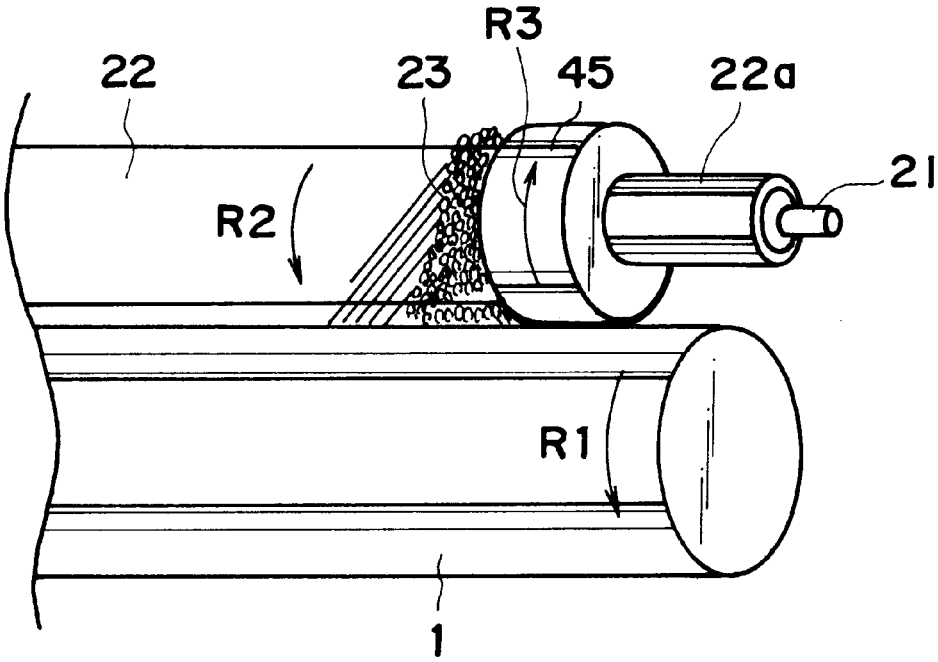
FIG. 19 is an embodiment showing a structure of a charging member according to embodiment 12.

FIG. 18 shows a specific structure. The electroconductive sponge 45 is mounted to a small diameter portion 22*a* of the charging sleeve 22, and is contacted to the magnetic particles 23, and therefore, has the same potential as the magnetic particles 23, thus charging the photosensitive member 1. As shown in FIG. 19, the electroconductive sponge 45 and the charging sleeve 22 are rotated independently from each other. Specifically, the charging sleeve 22 rotates in the direction of the arrow R2, and the photosensitive member 1 rotates in the direction R1, and the electroconductive sponge 45 rotates in the direction R3, following the photosensitive member 1 (driven by the contact with the photosensitive member). The electroconductive sponge 45 used in this embodiment, is the EPDM foamed member used in embodiment 10. In place of the electroconductive sponge 45, furbrush used in embodiment 11 is usable.

With this structure, the same advantages effects are provided. In addition, the electroconductive sponge (elastic member) 45 at the end portion is driven by the photosensitive member 1, and therefore, even if the magnetic particles 23 enter between the elastic and electroconductive sponge 45 and photosensitive member 1, the magnetic particles 23 pass while simply being nipped there, so that the photosensitive member 1 is not damaged.

The decreasing of the magnetic particles 23 can be avoided so that the charging property stability is maintained in the long term operation, and the damage to the photosensitive member 1 can be avoided.

The charging member of embodiment 10–13 and photosensitive member of embodiment 4, 5 may be combined. The charging member of embodiments 10–13 and second charging member of embodiments 7–9 may be combined.

In the case of of magnetic brush as in magnetic brush two component developing device, the development contrast (difference between the development potential and the drum surface), is smaller than the charging contrast (difference between the charge potential and the drum surface potential). Therefore, the carrier deposition of the magnetic brush to the drum, is not so significant as when the magnetic brush is used as the charging device. When the magnetic brush is used for the magnetic brush, the toner exists in the magnetic brush, so that the toner is first deposited on the drum. This is because the toner is lighter than the carrier of the magnetic brush, and the resistance is higher than that, and therefore, the retained charge potential is higher. Therefore, the toner is more easily deposited to the drum. So, the carrier of the magnetic brush is less deposited to the drum.

In the foregoing embodiments, the difference between the potential of the magnetic particle contacted to the photosensitive member at the end portion of the charging member and the potential of the photosensitive member, is decreased or eliminated, thus avoiding the deposition of the magnetic particles to the photosensitive member.

What is claimed is:

1. A charging member supporting magnetic particles for charging a member to be charged, said magnetic particles being contactable to the member to be charged, said charging member comprising:

an electroconductive member to which a voltage is applicable; and a member electrically insulated from said electroconductive member at an end portion, in a longitudinal direction of said charging member, of said magnetic particles, wherein said member electrically insulated from said electroconductive member is a second electroconductive member.

2. A charging member according to claim 1, wherein said second electroconductive member is electrically grounded.

3. A charging member according to claim 1, wherein said second electroconductive member supports said magnetic particles.

4. A charging member according to claim 1, wherein said member electrically insulated from said electroconductive member is contactable with said magnetic particles.

5. A charging apparatus comprising:

a charging member for charging a member to be charged, wherein said charging member includes magnetic particles in the form of a magnetic brush contactable to the member to be charged;

an electroconductive member to which a voltage is applicable; and a member electrically insulated from said electroconductive member at an end portion, in a longitudinal direction of said charging member, of said magnetic particles, wherein said member electrically insulated from said electroconductive member is a second electroconductive member.

6. An apparatus according to claim 5, wherein said second electroconductive member is electrically grounded.

7. An apparatus according to claim 5, wherein said second electroconductive member supports said magnetic particles.

8. An apparatus according to claim 7, wherein said second electroconductive member is provided on a surface of said electroconductive member that supports said magnetic particles.

9. An apparatus according to claim 8, wherein said second electroconductive member is in the form of a sheet.

10. An apparatus according to claim 7, wherein said second electroconductive member is provided on the same surface as the surface of said electroconductive member that supports said magnetic particles.

11. An apparatus according to claim 7, further comprising a magnet provided inside of said electroconductive member.

12. An apparatus according to claim 5, wherein said member electrically insulated from said electroconductive member is contactable with said magnetic particles.

13. An apparatus according to claim 5 wherein a resistance of said magnetic particles is $1\times10^4$–$1\times10^7$ Ohm.

14. An apparatus according to claim 5, wherein said member to be charged includes an image bearing member, and said image bearing member and said charging member are provided in a process cartridge detachable relative to an image forming apparatus.

15. An apparatus according to claim 5, wherein said second electroconductive member is extended from said end portion of said magnetic particles to a portion closer to a central portion than said end portion.

16. An apparatus according to claim 5, wherein said voltage is an AC voltage biased with a DC voltage.

17. An apparatus according to claim 5 wherein a resistance of said magnetic particles is $1\times10^4$–$1\times10^7$ Ohm.

18. An image forming apparatus comprising:

an image bearing member;

a charging member for charging said image bearing member;

wherein said charging member includes magnetic particles in the form of a magnetic brush contactable to said image bearing member;

an electroconductive member to which a voltage is applicable; and a member electrically insulated from said electroconductive member at an end portion, in a longitudinal direction of said charging member, of said magnetic particles, wherein said member electrically insulated from said electroconductive member is a second electroconductive member.

19. An apparatus according to claim 18, wherein said image bearing member includes a charge injection layer, to which charge is injected by contact with said magnetic particles.

20. An apparatus according to claim 19, wherein said charge injection layer has a volume resistivity of $1\times10^9$–$1\times10^{15}$ Ohm.cm.

21. An apparatus according to claim 18, wherein said second electroconductive member is electrically grounded.

22. An apparatus according to claim 18, wherein said second electroconductive member is extended from said end portion of said magnetic particles to a portion closer to a central portion than said end portion.

23. An apparatus according to claim 18 or 22, wherein said image bearing member is provided with a photosensitive layer, and an end portion of said photosensitive layer is outside said end portion of said magnetic particles in a longitudinal direction of said charging member.

24. An apparatus according to claim 1, 2, or 19, wherein said second electroconductive member supports said magnetic particles.

25. An apparatus according to claim 1, 2, or 19, wherein said member electrically insulated from said electroconductive member is contactable to said magnetic particles.

26. An apparatus according to claim 1, 2 or 19, wherein a resistance of said magnetic particles is $1\times10^4$–$1\times10^7$ Ohm.

27. A charging apparatus comprising:

a charging member for charging a member to be charged, wherein said charging member includes magnetic particles in the form of a magnetic brush contactable to the member to be charged;

an electroconductive member to which a charging voltage is applicable; and a member electrically insulated from said electroconductive member adjacent to a longitudinal end of the member to be charged, wherein said member electrically insulated from said, electroconductive member supports said magnetic particles adjacent the longitudinal end of said charging member.

28. An apparatus according to claim 27, wherein said member electrically insulated from said electroconductive member is a second electroconductive member.

29. An apparatus according to claim 28, wherein said second electroconductive member is electrically grounded.

30. An apparatus according to claim 27, wherein said electroconductive member supports said magnetic particles.

31. An apparatus according to claim 30, further comprising a magnet provided inside of said electroconductive member.

32. An apparatus according to claim 31, wherein said member electrically insulated from said electroconductive member is extended in a longitudinal direction of said charging member, from a central position of said magnet to an outside end of said magnet.

33. An apparatus according to claim 27, wherein said member to be charged includes an image bearing member, and said image bearing member and said charging member are provided in a process cartridge detachable relative to an image forming apparatus.

34. An apparatus according to claim 33, wherein said image bearing member is provided with a photosensitive layer, and an end portion of said photosensitive layer is outside said end portion of said magnetic particles in a longitudinal direction of said charging member.

35. A charging member according to claim 1, further comprising an insulating member providing electrical insulation between said electroconductive member and said second electroconductive member.

36. An apparatus according to claim 28, further comprising an insulating member providing electrical isolation between said electroconductive member and said second electroconductive member.

37. An apparatus according to claim 27, wherein said member electrically insulated from said electroconductive member is an electrically nonconductive member.

* * * * *

UNITED STATES PATENT AND TRADEMARK OFFICE

CERTIFICATE OF CORRECTION

PATENT NO. : 6,061,539

DATED : May 9, 2000

INVENTOR(S) : Harumi ISHIYAMA et al.

It is certified that error appears in the above-identified patent and that said Letters Patent is hereby corrected as shown below:

On the title page, item:

ITEM [56]

"NO." should read --No.--.

COLUMN 2

Line 42, "an a" should read --a--;
Line 45, "an a" should read --a--;
Line 49, "an a" should read --a--;
Line 52, "an a" should read --a--; and
Line 59, "EMBODIMENT" should read --EMBODIMENTS--.

COLUMN 3

Line 4, "a" should read --an--; and
Line 30, "toner" should be deleted.

COLUMN 4

Line 60, "FIG. 2(a)," should read --FIG. 2A,--.

COLUMN 5

Line 8, "direction direction" should read --direction--.

UNITED STATES PATENT AND TRADEMARK OFFICE

CERTIFICATE OF CORRECTION

PATENT NO. : 6,061,539

DATED : May 9, 2000

INVENTOR(S) : Harumi ISHIYAMA et al.

It is certified that error appears in the above-identified patent and that said Letters Patent is hereby corrected as shown below:

COLUMN 6

Line 21, "as for examples" should read --As, for example,--;
Line 38, "pin hole," should read --pinhole,--;
Line 39, "pin hole" should read --pinhole--;
Line 44, "follows;" should read --follows:--; and
Line 59, "a" (second occurrence) should be deleted.

COLUMN 8

Line 27, "the that" should read --that--;
Line 33, "approx." should read --approximately--;
Line 64, "Is" should read --is--; and
Line 67, "particle s." should read --particles.--.

COLUMN 9

Line 41, "7, F)" should read --boundary F (Figs. 6 and 7)--.

COLUMN 10

Line 1, "expands" should read --expand--;
Line 41, "above described" should read --above-described--; and
Line 48, "expands" should read --expand--.

UNITED STATES PATENT AND TRADEMARK OFFICE

CERTIFICATE OF CORRECTION

PATENT NO. : 6,061,539

DATED : May 9, 2000

INVENTOR(S) : Harumi ISHIYAMA et al.

It is certified that error appears in the above-identified patent and that said Letters Patent is hereby corrected as shown below:

COLUMN 12

Line 2, "in (c)," should read --in FIG. 10C,--;
Line 38, "of of" should read --be of--;
Line 50, "FIG. 11B" should read --FIG. 11B is --; and
Line 65, "FIG. 12," should read --FIG. 12B,--.

COLUMN 13

Line 11, "Sl" should read --S1--.

COLUMN 14

Line 65, "embodiment" should read --embodiments--.

COLUMN 15

Line 60, "KABUSHIKI KAISHA KABUSHIKI KAISHA," should read --KABUSHIKI KAISHA,--.

COLUMN 16

Line 41, "no" should read --does not--; and
Line 45, "does" should read --do--.

UNITED STATES PATENT AND TRADEMARK OFFICE

CERTIFICATE OF CORRECTION

PATENT NO. : 6,061,539

DATED : May 9, 2000

INVENTOR(S) : Harumi ISHIYAMA et al.

It is certified that error appears in the above-identified patent and that said Letters Patent is hereby corrected as shown below:

COLUMN 17

Line 17, "embodiment" should read --embodiments--;
Line 18, "embodiment" should read --embodiments--; and
Line 21, "of of" should read --of a--.

COLUMN 18

Line 19, "second" should be deleted;
Line 20, "electroconductive" should read --insulated--;
Line 30, "claim 5" should read --claim 5,--; and
Line 43, "claim 5" should read --claim 27,--.

COLUMN 19

Line 29, "member" (second occurrence) should be deleted; and
Line 30, "said," should read --said--.

UNITED STATES PATENT AND TRADEMARK OFFICE

CERTIFICATE OF CORRECTION

PATENT NO. : 6,061,539

DATED : May 9, 2000

INVENTOR(S) : Harumi ISHIYAMA et al. Page 5 of 5

It is certified that error appears in the above-identified patent and that said Letters Patent is hereby corrected as shown below:

COLUMN 20

Line 15, "member" should read --device--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,061,539
DATED : May 9, 2000
INVENTOR(S) : Harumi Ishiyama et al.

It is certified that error appears in the above-identified patent and that said Letters Patent is hereby corrected as shown below:

Title page,
Item [56], References Cited, U.S. PATENT DOCUMENTS,
"NO." should read -- No. --.

Column 2,
Lines 42, 45 and 49, "an a" should read -- a --;
Line 52, "an a" should read -- a --; and
Line 59, "EMBODIMENT" should read -- EMBODIMENTS --.

Column 3,
Line 4, "a" should read -- an --; and
Line 30, "toner" should be deleted.

Column 4,
Line 60, "FIG. 2(a)," should read -- FIG. 2A, --.

Column 5,
Line 8, "direction direction" should read -- direction --.

Column 6,
Line 21, "as for examples" should read -- As, for example, --;
Line 38, "pin hole," should read -- pinhole, --;
Line 39, "pin hole" should read -- pinhole --;
Line 44, "follows;" should read -- follows: --; and
Line 59, "a" (second occurrence) should be deleted.

Column 8,
Line 27, "the that" should read -- that --;
Line 33, "approx." should read -- approximately --;
Line 64, "Is" should read -- is --; and
Line 67, "particle s." should read -- particles. --.

Column 9,
Line 41, "7, F)" should read -- boundary F (Figs. 6 and 7) --.

Column 10,
Line 1, "expands" should read -- expand --;
Line 41, "above described" should read -- above-described --; and
Line 48, "expands" should read -- expand --.

UNITED STATES PATENT AND TRADEMARK OFFICE

CERTIFICATE OF CORRECTION

PATENT NO. : 6,061,539
DATED : May 9, 2000
INVENTOR(S) : Harumi Ishiyama et al.

It is certified that error appears in the above-identified patent and that said Letters Patent is hereby corrected as shown below:

Column 12,
Line 2, “in (c),” should read -- in FIG. 10C,--;
Line 38, “of of” should read -- be of --;
Line 50, “FIG. 11B” should read -- FIG. 11B is --; and
Line 65, “FIG. 12,” should read -- FIG. 12B, --.

Column 13,
Line 11, “S1” should read -- S 1 --.

Column 14,
Line 65, “embodiment” should read -- embodiments --.

Column 15,
Line 60, “KABUSHIKI KAISHA KABUSHIKI KAISHA,” should read -- KABUSHIKI KAISHA, --.

Column 16,
Line 41, “not” should read -- does not --; and
Line 45, “does” should read -- do --.

Column 17,
Lines 17 and 18, “embodiment” should read -- embodiments --; and
Line 21, “of of” should read -- of a --.

UNITED STATES PATENT AND TRADEMARK OFFICE

CERTIFICATE OF CORRECTION

PATENT NO. : 6,061,539
DATED : May 9, 2000
INVENTOR(S) : Harumi Ishiyama et al.

It is certified that error appears in the above-identified patent and that said Letters Patent is hereby corrected as shown below:

Column 18,
Line 19, “second” should be deleted;
Line 20, “electroconductive” should read -- insulated --;
Lines 30 and 43, “claim 5” should read -- claim 5, --

Column 19,
Line 30, “said,” should read -- said --.

Signed and Sealed this

Fourteenth Day of September, 2004

JON W. DUDAS
*Director of the United States Patent and Trademark Office*